US011946472B2

(12) United States Patent
Sheth et al.

(10) Patent No.: US 11,946,472 B2
(45) Date of Patent: Apr. 2, 2024

(54) CHARGE PUMP FOR ELECTRIC SUBMERSIBLE PUMP (ESP) ASSEMBLY WITH INVERTED SHROUD

(71) Applicant: Halliburton Energy Services, Inc., Houston, TX (US)

(72) Inventors: Ketankumar Kantilal Sheth, Tulsa, OK (US); Donn J. Brown, Tulsa, OK (US); Randy Louis Mathes, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 193 days.

(21) Appl. No.: 17/492,227

(22) Filed: Oct. 1, 2021

(65) Prior Publication Data

US 2023/0111850 A1 Apr. 13, 2023

(51) Int. Cl.
*E21B 43/00* (2006.01)
*E21B 43/12* (2006.01)
(Continued)

(52) U.S. Cl.
CPC ..... *F04D 13/08* (2013.01); *E21B 43/00* (2013.01); *E21B 43/128* (2013.01); *E21B 43/38* (2013.01); *F04D 3/02* (2013.01)

(58) Field of Classification Search
CPC ..... E21B 43/00; E21B 43/38; E21B 43/128
See application file for complete search history.

(56) References Cited

U.S. PATENT DOCUMENTS 3,195,661 A 7/1965 Jackson et al.
4,187,912 A 2/1980 Cramer
(Continued)

FOREIGN PATENT DOCUMENTS

CN 106076006 A 11/2016
CN 205965282 U 2/2017
(Continued)

OTHER PUBLICATIONS

Foreign Communication from Related Application—International Search Report and Written Opinion of the International Searching Authority, International Application No. PCT/US2021/042395, dated Mar. 25, 2022, 14 pages.
(Continued)

*Primary Examiner* — David Carroll
(74) *Attorney, Agent, or Firm* — Conley Rose, P.C.; Rodney B. Carroll

(57) ABSTRACT

An electric submersible pump (ESP) assembly. The ESP assembly comprises an electric motor; a seal section; a fluid intake; a charge pump assembly located downstream of the fluid intake and having an inlet in fluid communication with an outlet of the fluid intake, having a fluid mover coupled to a drive shaft, and having a fluid reservoir located downstream of the fluid mover; a gas separator located downstream of the charge pump assembly and having an inlet in fluid communication with an outlet of the charge pump assembly; an inverted shroud coupled at an upper end to the gas separator or to the charge pump assembly and coupled at a lower end to the ESP assembly below the fluid intake; and a production pump assembly located downstream of the gas separator and having an inlet in fluid communication with a liquid phase discharge port of the gas separator.

23 Claims, 12 Drawing Sheets

(51) Int. Cl.

| | |
|---|---|
| ***E21B 43/38*** | (2006.01) |
| ***F04D 3/02*** | (2006.01) |
| ***F04D 13/08*** | (2006.01) |

(56) References Cited

U.S. PATENT DOCUMENTS

| | | | | |
|---|---|---|---|---|
| 4,481,020 | A | 11/1984 | Lee et al. | |
| 4,901,413 | A | 2/1990 | Cotherman et al. | |
| 4,913,630 | A | 4/1990 | Cotherman et al. | |
| 5,207,810 | A | 5/1993 | Sheth | |
| 5,431,228 | A * | 7/1995 | Weingarten | E21B 43/38 166/69 |
| 5,525,146 | A | 6/1996 | Straub | |
| 6,066,193 | A * | 5/2000 | Lee | E21B 43/38 96/216 |
| 6,113,675 | A * | 9/2000 | Branstetter | B01D 19/0052 96/196 |
| 6,155,345 | A * | 12/2000 | Lee | E21B 43/121 96/217 |
| 6,382,317 | B1 | 5/2002 | Cobb | |
| 6,412,562 | B1 | 7/2002 | Shaw | |
| 6,705,402 | B2 | 3/2004 | Proctor | |
| 7,461,692 | B1 | 12/2008 | Wang | |
| 7,462,225 | B1 | 12/2008 | Ketter et al. | |
| 7,766,081 | B2 | 8/2010 | Brown et al. | |
| 8,079,418 | B2 | 12/2011 | Brown et al. | |
| 8,955,598 | B2 | 2/2015 | Brown et al. | |
| 9,283,497 | B2 | 3/2016 | Wang et al. | |
| 10,378,322 | B2 | 8/2019 | Ejim et al. | |
| 10,408,035 | B2 | 9/2019 | Kennedy et al. | |
| 11,149,535 | B2 | 10/2021 | Brown et al. | |
| 11,624,269 | B2 | 4/2023 | Sheth et al. | |
| 11,661,828 | B2 | 5/2023 | Conrad et al. | |
| 2002/0153141 | A1 | 10/2002 | Hartman et al. | |
| 2002/0174982 | A1 * | 11/2002 | Weingarten | E21B 43/38 166/69 |
| 2003/0111230 | A1 | 6/2003 | Olson et al. | |
| 2004/0031608 | A1 | 2/2004 | Hall et al. | |
| 2009/0065202 | A1 * | 3/2009 | Brown | E21B 43/128 166/267 |
| 2009/0194295 | A1 | 8/2009 | Thompson et al. | |
| 2010/0147514 | A1 | 6/2010 | Swaringin | |
| 2010/0319926 | A1 * | 12/2010 | Reid | F04B 23/08 417/205 |
| 2011/0162832 | A1 * | 7/2011 | Reid | E21B 43/38 166/244.1 |
| 2012/0012332 | A1 | 1/2012 | Rooks | |
| 2012/0073800 | A1 | 3/2012 | Janitz | |
| 2013/0068455 | A1 | 3/2013 | Brown et al. | |
| 2014/0174734 | A1 | 6/2014 | Gill et al. | |
| 2015/0192141 | A1 | 7/2015 | Nowitzki et al. | |
| 2016/0130922 | A1 | 5/2016 | Wilson et al. | |
| 2016/0130923 | A1 * | 5/2016 | Nowitzki | F04D 29/426 166/66.4 |
| 2016/0201444 | A1 * | 7/2016 | Hardee | E21B 43/128 166/265 |
| 2016/0312590 | A1 | 10/2016 | Chang et al. | |
| 2017/0081952 | A1 | 3/2017 | Osborne et al. | |
| 2019/0162063 | A1 | 5/2019 | Brown et al. | |
| 2019/0234193 | A1 | 8/2019 | Fehri | |
| 2019/0316452 | A1 | 10/2019 | Brown et al. | |
| 2020/0141223 | A1 | 5/2020 | Brown et al. | |
| 2020/0362649 | A1 | 11/2020 | Brown et al. | |
| 2022/0065090 | A1 | 3/2022 | Ejim | |
| 2023/0010704 | A1 | 1/2023 | Sheth et al. | |
| 2023/0014297 | A1 | 1/2023 | Brown et al. | |
| 2023/0105823 | A1 | 4/2023 | Brown et al. | |
| 2023/0220751 | A1 | 7/2023 | Sheth et al. | |

FOREIGN PATENT DOCUMENTS

| | | | |
|---|---|---|---|
| WO | 2017053624 | A1 | 3/2017 |
| WO | 2020072078 | A1 | 4/2020 |
| WO | 2023282919 | A1 | 1/2023 |
| WO | 2023282920 | A1 | 1/2023 |

OTHER PUBLICATIONS

Foreign Communication from Related Application—International Search Report and Written Opinion of the International Searching Authority, International Application No. PCT/US2021/042389, dated Apr. 4, 2022, 11 pages.

Office Action dated Jan. 3, 2023 (50 pages), U.S. Appl. No. 17/369,526, filed Jul. 7, 2021.

Foreign Communication from Related Application—International Search Report and Written Opinion of the International Searching Authority, International Application No. PCT/US2023/013758, dated Jun. 9, 2023, 10 pages.

Office Action dated Nov. 10, 2022 (25 pages), U.S. Appl. No. 17/369,511, filed Jul. 7, 2021.

Filing Receipt, Specification and Drawings for U.S. Appl. No. 17/954,849, filed Sep. 28, 2022, entitled "Electric Submersible Pump (ESP) Shroud System," 56 pages.

Filing Receipt, Specification and Drawings for U.S. Appl. No. 17/954,855, filed Sep. 28, 2022, entitled "Electric Submersible Pump (ESP) Assembly Fluid Intake Extension," 61 pages.

Final Office Action dated May 22, 2023 (9 pages), U.S. Appl. No. 17/369,526, filed Jul. 7, 2021.

Filing Receipt, Specification and Drawings for U.S. Appl. No. 17/369,511, filed Jul. 7, 2021, titled "Integrated Gas Separator and Pump," 69 pages.

Electronic Acknowledgment Receipt, Specification and Drawings for International Application No. PCT/US2021/042389, entitled "Integrated Gas Separator and Pump," filed Jul. 20, 2021, 50 pages.

Filing Receipt, Specification and Drawings for U.S. Appl. No. 17/369,526, filed Jul. 7, 2021, titled "Electric Submersible pump (ESP) Gas Slug Processor and Mitigation System," 70 pages.

Electronic Acknowledgment Receipt, Specification and Drawings for International Application No. PCT/US2021/042395, entitled "Electric Submersible Pump (ESP) Gas Slug Processor and Mitigation System," filed Jul. 20, 2021, 51 pages.

Filing Receipt, Specification and Drawings for U.S. Appl. No. 17/492,230, filed Oct. 1, 2021, titled "Charge Pump for Electric Submersible Pump (ESP) Assembly," 59 pages.

Foreign Communication from Related Application—International Search Report and Written Opinion of the International Searching Authority, International Application No. PCT/US2020/022038, dated Nov. 27, 2020, 13 pages.

Foreign Communication from Related Application—International Search Report and Written Opinion of the International Searching Authority, International Application No. PCT/US2023/025736, dated Oct. 17, 2023, 11 pages.

First Office Action dated Jun. 8, 2023 (34 pages), U.S. Appl. No. 17/737,148, filed May 5, 2022.

Schlumberger Oilfield Glossary entry for "slug flow", accessed Sep. 8, 2023 via glossary.slb.com.

Office Action dated Sep. 14, 2023 (42 pages), U.S. Appl. No. 17/369,526, filed Jul. 7, 2021.

Foreign Communication from Related Application—International Search Report and Written Opinion of the International Searching Authority, International Application No. PCT/US2023/025717, dated Oct. 12, 2023, 12 pages.

* cited by examiner

CHARGE PUMP FOR ELECTRIC SUBMERSIBLE PUMP (ESP) ASSEMBLY WITH INVERTED SHROUD

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore, Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more production pumps (e.g., a centrifugal pump assembly). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the production pump. Fluids, for example reservoir fluids, may enter the wellbore where they may flow past the outside of the motor to the pump intake. These fluids may then be produced by being pumped to the surface via the production tubing by the production pump, which discharges the reservoir fluids into the production tubing.

The reservoir fluids that enter the pump intake may sometimes comprise a gas fraction. These gases may flow upwards through the liquid portion of the reservoir fluid in the production. The gases may even separate from the other fluids when the production pump is in operation. If a large volume of gas enters the pump intake, or if a sufficient volume of gas accumulates on the suction side of the production pump, the gas may interfere with operation of the production pump and potentially prevent the intake of the reservoir fluid. This phenomenon is sometimes referred to as a "gas lock" because the production pump may not be able to operate properly due to the accumulation of gas within the production pump.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
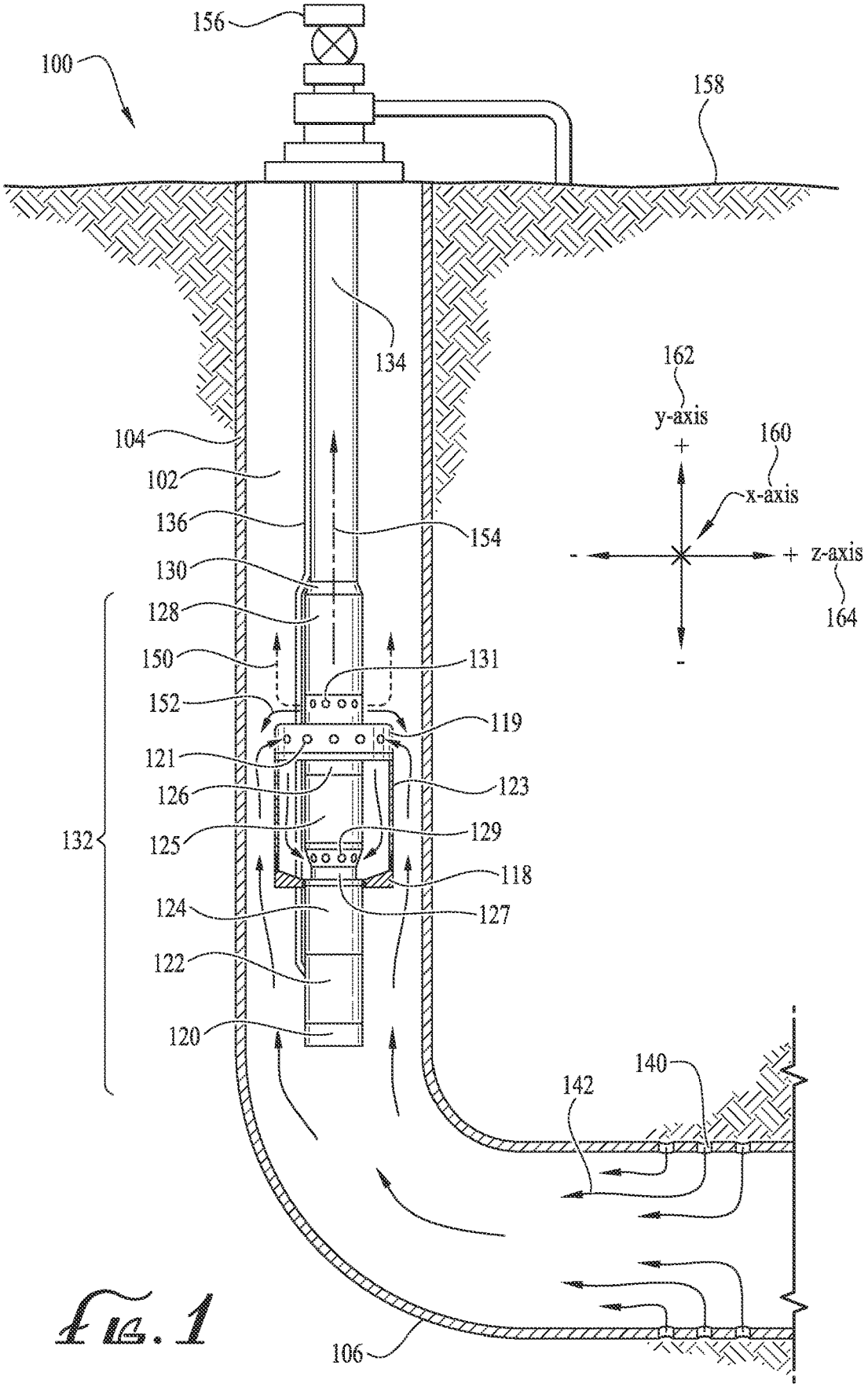
FIG. 1 is an illustration of an electric submersible pump (ESP) assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Gas entering a production pump assembly of an electric submersible pump (ESP) assembly can cause various difficulties. In an extreme case, the production pump may become gas locked and become unable to pump fluid to the surface (e.g., up the production tubing to the surface). In less extreme cases, the production pump may experience harmful operating conditions when transiently passing a slug of gas. When in operation, the production pump (e.g., a centrifugal pump comprising one or more stages each comprising an impeller coupled to a drive shaft of the centrifugal pump assembly and a diffuser retained by a housing of the centrifugal pump assembly) rotates at a high rate of speed (e.g., between about 3450 RPM and 3650 RPM) and relies on the continuous flow of reservoir liquid to both cool and lubricate its bearing surfaces. When this continuous flow of reservoir liquid is interrupted, even for a brief period of seconds, the bearings of the production pump may heat up rapidly and undergo significant wear, shortening the operational life of the production pump, thereby increasing operating costs due to more frequent change-out and/or repair of the production pump. Down time involved in repairing or replacing the production pump may also interrupt well production undesirably. In some operating environments, for example in some horizontal wellbores, gas slugs that persist for at least 10 seconds are repeatedly experienced. Some gas slugs may persist for as much as 30 seconds or more. A gas separator in some production environments can mitigate the deleterious effects of gas in the reservoir fluid on the production pump.

A gas separator assembly may impart rotating motion to reservoir fluid, feed the rotating reservoir fluid into a separation chamber of the gas separator assembly where a gas phase fluid concentrates near a drive shaft of the gas separator assembly and a liquid phase fluid concentrates near an inside of a housing of the gas separator assembly. The gas phase fluid enters a gas phase fluid discharge channel and flows out of gas discharge ports of the gas separator assembly, and the liquid phase fluid enters a liquid phase fluid discharge channel and flows out of liquid phase discharge ports to an inlet of a production pump. In this way, a liquid phase enriched fluid can be provided to the production pump. In the circumstance of a large slug of gas reaching the ESP assembly, however, the gas separator assembly may quickly fill with gas. In this circumstance, there is no liquid phase fluid fraction to separate and forward on as a liquid enriched fluid fraction to the production pump.

The present disclosure teaches including a charge pump assembly in the ESP assembly downstream of a fluid intake and upstream of the gas separator and including an inverted shroud in the ESP assembly to accumulate primarily liquid phase fluid to feed into the fluid intake. The inverted shroud stores a reservoir of primarily liquid phase fluid during normal ESP operation (e.g., when a gas slug is not present) that can be drawn down during a transient gas slug, whereby to continue feeding a primarily liquid phase fluid into the fluid intake. The charge pump assembly comprises one or more fluid movers and one or more fluid reservoirs. In an embodiment, the charge pump assembly comprises one or more fluid movers and zero fluid reservoirs (e.g., no extended empty annular spaces as described further hereinafter).

Under normal operating conditions, the reservoir fluid received into the fluid intake and flowed to the charge pump assembly is primarily liquid phase fluid. The fluid mover flows the liquid phase fluid into the fluid reservoir, filling the fluid reservoir with liquid phase fluid, and flowing the liquid phase fluid out of the fluid reservoir into an inlet of the gas separator assembly. When a large gas slug arrives at the fluid intake, when the primarily liquid phase fluid accumulated in the inverted shroud has been entirely depleted, and gas is flowed into the fluid mover of the charge pump assembly, the gas mixes with the liquid phase fluid retained by the fluid reservoir of the charge pump assembly. Thus, even when a large gas slug arrives at the ESP assembly, the charge pump assembly can continue to flow a mixture of liquid phase fluid and gas phase fluid to the gas separator assembly for a period of time, allowing the gas separator to continue to supply an enriched liquid phase fluid stream to the centrifugal pump assembly or production pump assembly.

By extending the length of the inverted shroud (e.g., during design and/or manufacturing of the ESP assembly), the length of time the ESP assembly can sustain a gas slug before gas fills the inverted shroud and begins feeding into the charge pump assembly may be increased. Additionally, by increasing the volume of the fluid reservoir incorporated within the charge pump assembly (e.g., during design and/or manufacturing of the ESP assembly), the period of time during which the ESP assembly can sustain a gas slug may be increased. The volume of the fluid reservoir may be increased by extending the length of the fluid reservoir, for example by incorporating spider bearings to support the drive shaft of the charge pump assembly across the extended fluid reservoir spaces. The charge pump assembly may comprise a plurality of fluid movers that may contribute to better mixing gas from a gas slug with liquid phase fluid retained within the fluid reservoir or plurality of fluid reservoirs incorporated in the charge pump assembly. Extending the length of the inverted shroud and increasing the length of the fluid reservoir(s) in the charge pump assembly can be accomplished in a complementary manner. For example, by extending both the length of the inverted shroud and the length of the fluid reservoir(s), a kind of double-benefit may be achieved—increasing the accumulated reservoir fluid in the inverted shroud and increasing the accumulated reservoir fluid in the fluid reservoir in the interior of the charge pump assembly.

Turning now to FIG. 1 a wellsite environment 100, according to one or more aspects of the disclosure, is described. The wellsite environment 100 comprises a wellbore 102 that is at least partially cased with casing 104. As depicted in FIG. 1, the wellbore 102 has a deviated or horizontal portion 106, but the electric submersible pump (ESP) assembly 132 described herein may be used in a wellbore 102 that does not have a deviated or horizontal portion 106. The wellsite environment 100 may be at an on-shore location or at an off-shore location. The ESP assembly 132 in an embodiment comprises a sensor package 120, an electric motor 122, a seal unit 124, a fluid intake 127 having intake ports 129, a charge pump assembly 125, a gas separator assembly 126 that comprises gas discharge ports 131, a production pump assembly 128, and an inverted shroud 123 that encloses a portion of the ESP assembly 132. The production pump assembly 128 may be referred to as a centrifugal pump assembly in some contexts. The production pump assembly 128 may be coupled to a production tubing 134 via a discharge 130. An electric cable 136 may attach to the electric motor 122 and extend to the surface 158 to connect to an electric power source.

The inverted shroud 123 has a shroud inlet 119 that defines shroud inlet ports 121. The inverted shroud 123 may comprise a tubular that is threadingly coupled at a top end to the shroud inlet 119. The shroud inlet 119 may be integrated with or, alternatively, coupled to a clamp assembly that secures the top of the inverted shroud 123 to the outside of the gas separator assembly 126 or to the outside of the charge pump assembly 125. In an embodiment, the shroud inlet 119 or a clamp assembly provides a path for the electric cable 136 to pass through to an inside of the inverted shroud 123. The lower end of the inverted shroud 123 may threadingly couple to a shroud base 118, and the shroud base 118 may attach to the ESP assembly 132 between the seal section 124 and the fluid intake 127. In another embodiment, the shroud base 118 may attach to the ESP assembly 132 between the seal section 124 and the electric motor 122 (e.g., at a pot head or at a motor head that couples the electric motor 122 to the seal section 124).

The casing 104 and/or wellbore 102 may have perforations 140 that allow reservoir fluid 142 to pass from the subterranean formation through the perforations 140 and into the wellbore 102. The reservoir fluid 142 may flaw uphole towards shroud inlet 119, flow through the inlet ports 121 of the shroud inlet 119, enter the inside of the inverted shroud 123, flow downwards in an annulus defined between an inside surface of the tubular of the inverted shroud 123 and an outside surface of the gas separator 126 and/or an outside surface of the charge pump 125, and flow into the intake ports 129 of the fluid intake 127. A seal between the shroud base 118 and the ESP assembly 132 below the fluid intake 127 may prevent the reservoir fluid 142 from passing between the shroud base 118 and the seal section 124 or motor head to arrive directly at the intake ports 129.

The reservoir fluid 142 may comprise a liquid phase fluid. The reservoir fluid 142 may comprise a gas phase fluid mixed with a liquid phase fluid. The reservoir fluid 142 may comprise only a gas phase fluid (e.g., simply gas). Over time, the gas to fluid ratio of the reservoir fluid 142 may change dramatically. For example, in the horizontal portion 106 of the wellbore gas may build up in high points in the roof of the wellbore 102 and after accumulating sufficiently may "burp" out of these high points and flow downstream to the ESP assembly 132 as what is commonly referred to as a gas slug. Thus, immediately before a gas slug arrives at the ESP assembly 132, the gas fluid ratio of the reservoir fluid 142 may be very low (e.g., the reservoir fluid 142 at the ESP assembly 132 is mostly liquid phase fluid); when the gas slug arrives at the ESP assembly 132, the gas fluid ratio is very high (e.g., the reservoir fluid 142 at the ESP assembly 132 is entirely or almost entirely gas phase fluid); and after the gas slug has passed the ESP assembly 132, the gas fluid ratio may again be very low (e.g., the reservoir fluid 142 at the ESP assembly 132 is mostly liquid phase fluid).

During normal operation, the interior of the inverted shroud 123 fills up with reservoir fluid 142 that is primarily liquid phase fluid. When a gas slug arrives at the ESP assembly 132, the gas slug may pass upwards beyond the shroud inlet 119 and up the wellbore 102. The charge pump assembly 125, the gas separator assembly 126, and the production pump assembly 128 continue to process the primarily liquid phase fluid that had accumulated in the inside of the inverted shroud 123, drawing down the level of this accumulated primarily liquid phase fluid inside the inverted shroud 123. As the level of accumulated primarily liquid phase fluid drops inside the inverted shroud 123, primarily gas phase fluid fills in the top portion of the interior of the inverted shroud 123. Thus, the primarily liquid phase fluid that had accumulated in the inside of the inverted shroud 123 acts as a sort of buffer to permit the ESP assembly 132 to continue normal operation during transient gas slug events. When the gas slug has passed and the reservoir fluid 142 arriving at the shroud inlet 119 is again primarily liquid phase fluid, the interior of the inverted shroud 123 fills up again with the primarily liquid phase fluid.

In an embodiment, the inverted shroud 123 can be any length. In an embodiment, the inverted shroud 123 may be composed of a plurality of separate tubulars that are coupled together to form a continuous cylinder by threadingly connecting with each other. In an embodiment, the shroud inlet 119 is coupled to the gas separator assembly 126 below the gas discharge ports 132, whereby to allow the fluid discharged by the gas separator assembly 126 to exhaust gas uphole above the shroud inlet 119. In an embodiment, the length of the inverted shroud 123 is less than 500 feet and at least 4 feet, at least 6 feet, at least 8 feet, at least 10 feet, at least 12 feet, at least 14 feet, at least 16 feet, at least 18 feet, at least 20 feet, at least 22 feet, at least 24 feet, at least 26 feet, at least 28 feet, at least 30 feet, at least 32 feet, at least 35 feet, at least 40 feet, at least 45 feet, at least 50 feet, at least 60 feet, at least 70 feet, at least 80 feet, at least 90 feet, at least 100 feet, at least 120 feet, or at least 140 feet. The length of the charge pump assembly 125 may be adapted in length to accommodate a greater or lesser length of the inverted shroud 123.

Under normal operating conditions (e.g., reservoir fluid 142 is flowing out of the perforations 140, the ESP assembly 132 is energized by electric power, the electric motor 122 is turning, and a gas slug is not present at the ESP assembly 132), the reservoir fluid 142 enters the intake ports 129 of the fluid intake 127, the reservoir fluid 142 flows into the charge pump assembly 125, the reservoir fluid 142 flows from the charge pump assembly 125 into the gas separator assembly 126, the reservoir fluid 142 is separated by the gas separator assembly 126 into a gas phase fluid (or a mixed-phase fluid having a higher gas liquid ratio than the reservoir fluid 142 entering the intake ports 129) and a liquid phase fluid (or a mixed-phase fluid having a lower gas liquid ratio than the reservoir fluid 142 entering the intake ports 129). The gas phase fluid is discharged via the gas phase discharge ports 131, and the liquid phase fluid is flowed downstream to the production pump assembly 128 as liquid phase fluid 154. Under normal operating conditions, the gas phase fluid that is discharged into the annulus between the casing 104 and the outside of the ESP assembly 132 may comprise both gas phase fluid 150 that rises uphole in the wellbore 102 and liquid phase fluid 152 that falls downhole in the wellbore 102. The production pump assembly 128 flows the liquid phase fluid 154 (e.g., a portion of the reservoir fluid 142) up the production tubing 134 to a wellhead 156 at the surface 158.

An orientation of the wellbore 102 and the ESP assembly 132 is illustrated in FIG. 1 by an x-axis 160, a y-axis 162, and a z-axis 164. In an embodiment, the production pump assembly 128 comprises one or more centrifugal pump stages, where each stage comprises an impeller that is mechanically coupled to a drive shaft within the production pump assembly 128 and a corresponding diffuser that is stationary and retained by a housing of the production pump assembly 128. In an embodiment, the housing of the production pump assembly 128 comprises a metal tubular structure. In an embodiment, the impellers may comprise a keyway that mates with a corresponding keyway on the drive shaft of the production pump assembly 128 and a key may be installed into the two keyways, whereby the impeller may be mechanically coupled to the drive shaft of the production pump assembly 128.

Figure 2:
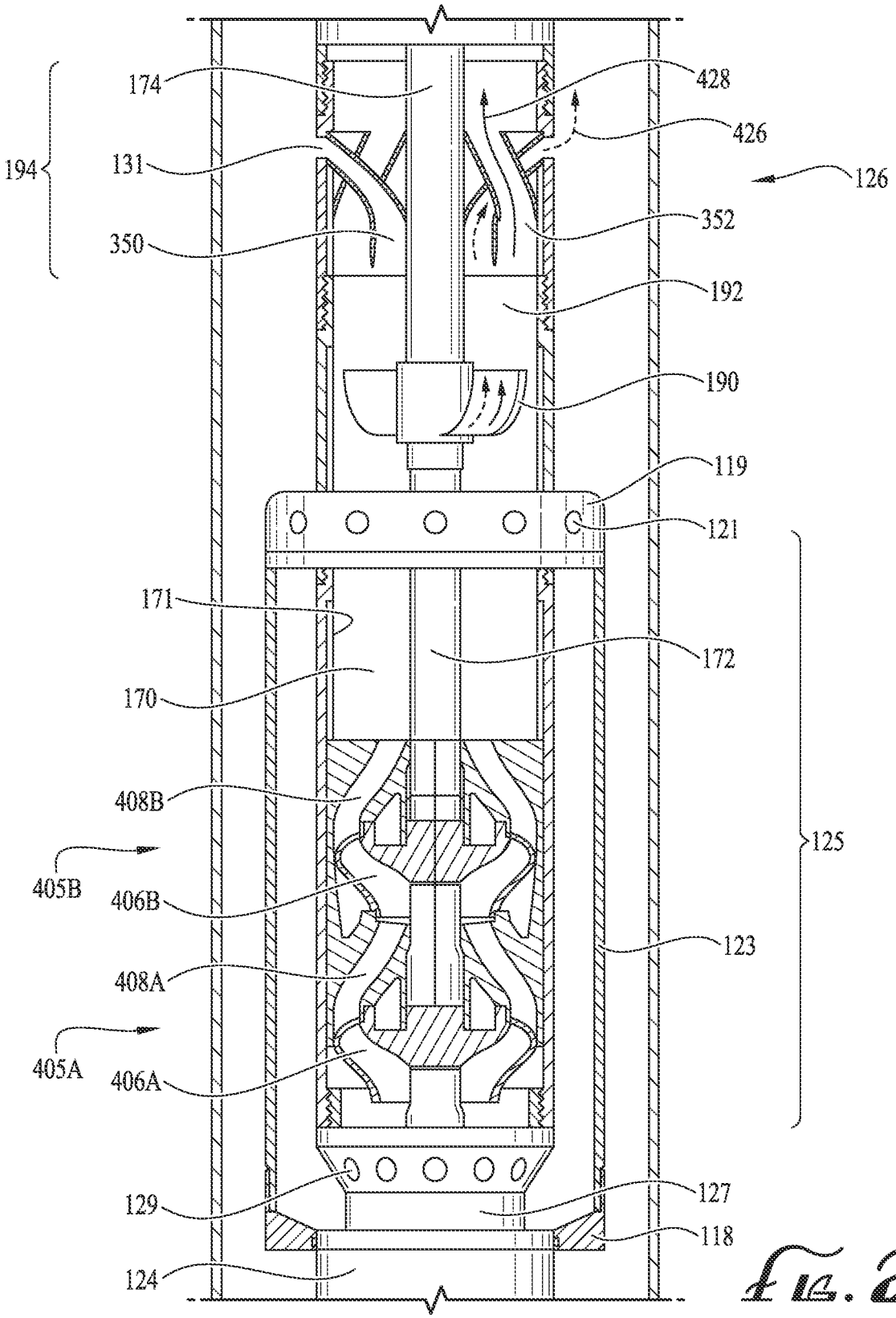
FIG. 2 is an illustration of a charge pump assembly according to an embodiment of the disclosure and FIG. 9 is an illustration of a charge pump assembly incorporating an auger according to another embodiment of the disclosure.

Turning now to FIG. 2, further details of the charge pump assembly 125 and the gas separator assembly 126 are described. In an embodiment, the charge pump assembly 125 comprises a fluid mover including a first centrifugal pump stage 405A and a second centrifugal pump stage 405B. Each centrifugal pump stage 405 comprises an impeller 406 coupled to a drive shaft 172 of the charge pump assembly 125 and a diffuser 408 retained by a housing of the charge pump assembly 125. The first centrifugal pump stage 405A comprises a first impeller 406A coupled to the drive shaft 172 and a first diffuser 408A coupled to a housing of the charge pump assembly 125. The housing of the charge pump assembly 125 may be an extended tubular metal structure. The second centrifugal pump stage 405E comprises a second impeller 406B coupled to the drive shaft 172 and a second diffuser 468E coupled to the housing of the charge pump assembly 125. In an embodiment, a lower end of the housing of the charge pump assembly 125 is threadingly coupled to an upper end of the fluid intake 127.

An interior of the fluid intake 127 and the intake ports 129 are in fluid communication with an interior of the charge pump assembly 125, for example in fluid communication with an inlet of the first impeller 406A of the first centrifugal pump stage 405A. While the ESP assembly 132 is in operation, reservoir fluid 142 may flow through the intake ports 129 into the interior of the fluid intake 127, into the inlet of the first impeller 406A, from the first impeller 406A into the first diffuser 408A, from the first diffuser 408A into the second impeller 406B, from the second impeller 406B into the second diffuser 408B, and from the second diffuser 498E into a fluid reservoir 170. While the charge pump assembly 125 of FIG. 2 is illustrated having two centrifugal pump stages 405A, 405B, the charge pump assembly 125 may comprise a single centrifugal pump stage or three or more centrifugal pump stages. The reservoir fluid 142 may then be flowed from the fluid reservoir 170 to an inlet of the gas separator assembly 126.

The charge pump assembly 125 may be said to be a "charge pump" because it flows or supplies the reservoir fluid 142 to the gas separator assembly 126 and to the production pump assembly 128, while it is the production pump assembly 128 that imparts significant lifting pressure to the reservoir fluid 154 whereby to lift it to the surface 158. The charge pump assembly 125 may "charge" the reservoir fluid 142 or drive the reservoir fluid 142 up into the inlet of the gas separator assembly 126 at a desired flow rate to support both a desired rate of producing fluid 154 to the surface 158 via the production tubing 134 as well as to supply the fluid 150, 152 exhausted out the gas discharge ports 131 of the gas separator assembly 126.

Figure 9:
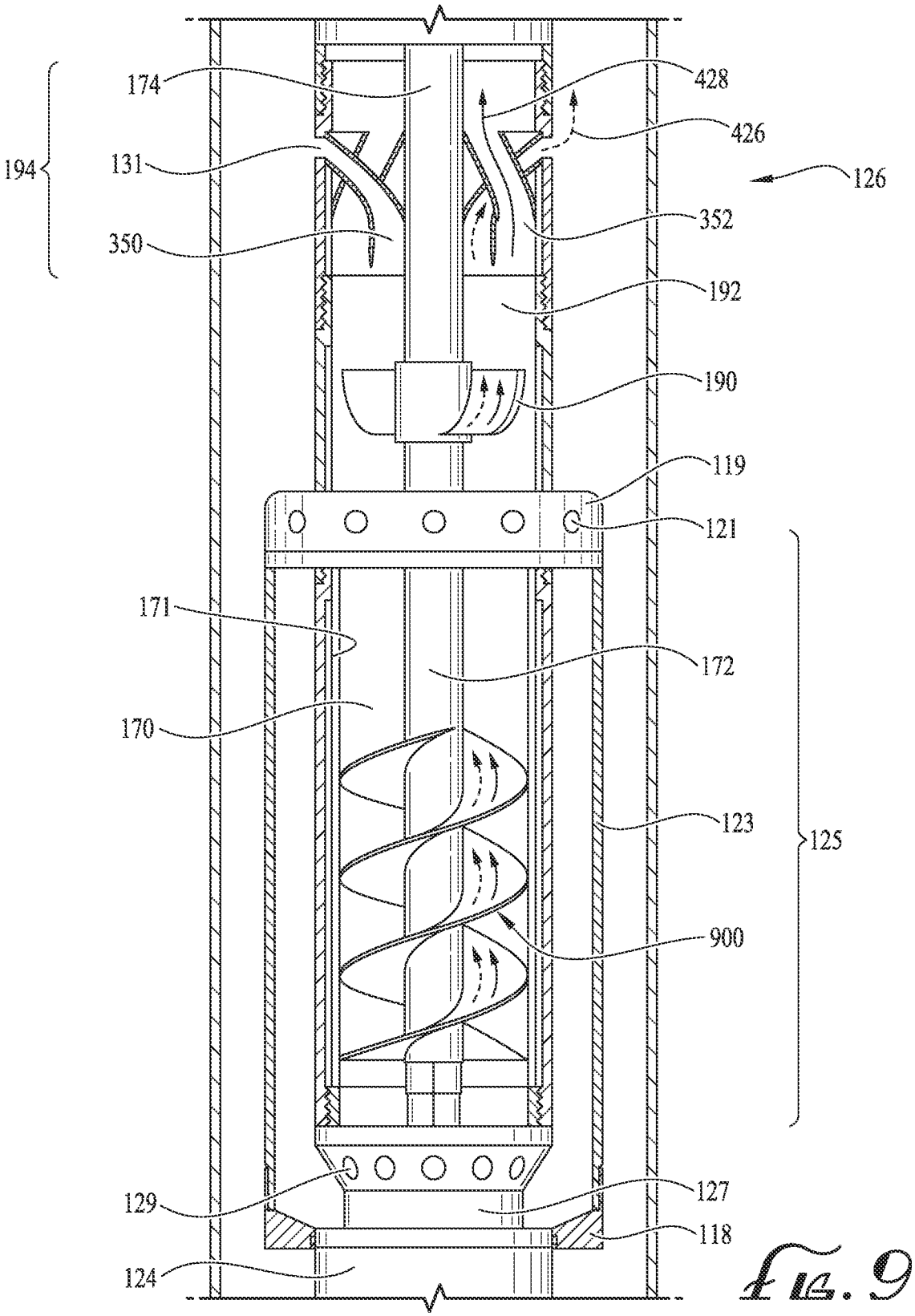

The fluid reservoir 170 is an annular space defined between an outside surface of the drive shaft 172 of the charge pump assembly 125 and an inside surface 171 of the housing of the charge pump assembly 125, The fluid reservoir 170 serves as an empty space to receive and retain reservoir fluid 142 during normal operation of the ESP assembly 132. (e.g., when the reservoir fluid 142 received by the fluid intake 127 is mostly liquid phase fluid). When a gas slug impinges upon the ESP assembly 132, fills the inside of the inverted shroud 123, and enters the intake ports 129 of the fluid intake 127, the reservoir fluid 142 retained within the fluid reservoir 170 can be mixed with the incoming gas by the charge pump assembly 125 to provide at least a partial mix of gas phase fluid and liquid phase fluid to the gas separator assembly 126 for a period of time. While the interior passages of the impellers 406 and diffusers 408 of the centrifugal pump stages 405 retain liquid phase fluid prior to impingement of a gas slug, this volume of liquid phase fluid is relatively small and may be quickly replaced by gas in the presence of a gas slug. By contrast, the volume of the fluid reservoir 170 can be considerably larger than the interior passageways of the centrifugal pump stages 405 and can therefore continue to provide some liquid phase fluid mixed with gas to the gas separator assembly 126 for a longer period of time. In an embodiment, the upper end of the charge pump assembly 125 is threadingly coupled to a lower end of the gas separator assembly 126. In an embodiment, the fluid mover of the charge pump assembly 125 is not a centrifugal pump stage but instead is an auger 900 coupled to the drive shaft 125 as illustrated in FIG. 9.

The gas separator assembly 126 comprises a fluid mover 190 that induces rotational motion to the reservoir fluid 142 received from an outlet of the charge pump assembly, for example from the fluid reservoir 170. The rotating reservoir fluid 142 flows into a separation chamber 192 of the gas separator assembly 126 where a gas phase fluid concentrates near a drive shaft 174 of the gas separator assembly 126 and a liquid phase fluid concentrates near an inside surface of a housing of the gas separator assembly 126. The concentrated gas phase fluid 426 enters a gas discharge channel 350 and exits the gas separator assembly 126 to the wellbore 102, and the concentrated liquid phase fluid 428 enters a liquid discharge channel 352 and flows to an inlet of the production pump assembly 128. The gas discharge channel 350 and the liquid discharge channel 352 are provided in a gas flow path and liquid flow path separator 194.

In an embodiment, the fluid mover 190 is coupled to the drive shaft 174 of the gas separator assembly 126. In an embodiment, the fluid mover 190 may be a paddlewheel or a rotating auger. The gas separator assembly 126 may be over-staged. As used herein, the term 'over-staged' means the gas separator assembly 126 is designed to receive and process more reservoir fluid 142 than it delivers downstream to the production pump assembly 128. For example, if it is desired that 4000 barrels per day of reservoir fluid 142 be delivered to the wellhead 156 at the surface, then 4000 barrels per day of reservoir fluid 142 must be supplied by the gas separator assembly 126 to the production pump assembly 128. If the gas separator assembly 126 is to be able to supply 4000 barrels per day of reservoir fluid 142 to the production pump assembly 128, the gas separator assembly 126 must be designed to process more than 4000 barrels per day of reservoir fluid 142, because a portion of the reservoir fluid 142 received by the gas separator assembly 126 is flowed out the gas discharge channel 350 and out the gas discharge ports 131. Thus, as an example, the gas separator assembly 126 may be designed so that the fluid mover 190 is able to process 5500 barrels per day of reservoir fluid 142, where 1500 barrels per day of gas phase fluid is flowed out the gas discharge ports 131 to be discharged into the wellbore 102 and 4000 barrels per day of liquid phase fluid is flowed out the liquid discharge channel 352 an into the production pump assembly 128. The charge pump assembly 125 may be designed to provide the appropriate flow rate to the gas separator assembly 126, for example to provide 5500 barrels per day of reservoir fluid 142 to the inlet of the gas separator assembly 126.

In an embodiment, the fluid mover 190 is a stationary auger and a second fluid mover of the gas separator assembly 126 is located upstream of the fluid mover 190 and flows the reservoir fluid 142 through the stationary auger whereby to induce the desired rotation of the reservoir fluid 142. The second fluid mover of the gas separator assembly 126 may be one or more centrifugal pump stages having impellers coupled to the drive shaft 174 or an auger coupled to the drive shaft 174.

In an embodiment, the gas separator assembly 126 comprises a third fluid mover downstream of the liquid discharge channel 352 and drives the reservoir fluid 142 across to the production pump assembly 128. In an embodiment, the ESP assembly 132 comprises a tandem gas separator. A tandem gas separator comprises two gas separator assemblies 126 where a lower gas separator assembly 126 is coupled to an upper gas separator and where the liquid phase discharge 352 of the lower gas separator assembly 126 feeds reservoir fluid 142 to the inlet of the upper gas separator assembly 126, and where the liquid phase discharge 352 of the upper gas separator assembly 126 feeds reservoir fluid 142 to the inlet of the production pump assembly 128. The upper gas separator assembly 126 may be over-staged so that the flow of reservoir fluid 142 from the liquid phase discharge channel 352 to the inlet of the gas separator assembly 126 is greater than the desired flow of liquid phase fluid 428 provided to the inlet of the production pump assembly 128, to take into consideration of the exhausting of a portion of the reservoir fluid 142 out the upper gas separator's gas phase discharge channel 350; and the lower gas separator assembly 126 may be twice over-staged so that the flow of reservoir fluid 142 from the liquid phase discharge channel 352 to the inlet of the upper gas separator assembly 126 provides the desired inflow to support the over-staging of the upper gas separator assembly 126.

In an embodiment, the ESP assembly 132 comprises a first charge pump assembly 125 coupled at an upstream end to the fluid intake 127 and coupled at a downstream end to an upstream end of a first gas separator assembly 126 and a second charge pump assembly 125 coupled at an upstream end to a downstream end of the first gas separator assembly 126 and coupled at a downstream end to a second gas separator assembly 126. The second gas separator assembly 126 is coupled at a downstream end to an upstream end of the production pump assembly 128.

In an embodiment, the drive shaft 172 of the charge pump assembly 125 is mechanically coupled to a drive shaft of the seal unit 124, and the drive shaft of the seal unit 124 is mechanically coupled to a drive shaft of the electric motor 122. Thus, the drive shaft 172 and the impellers 406 (e.g., impellers 406A and 406B in FIG. 2) of the one or more centrifugal pump stages 405 of the charge pump assembly 125 are turned indirectly by the electric motor 122 when it is energized by electric power via the electric cable 136. The drive shaft 172 of the charge pump assembly 125 is mechanically coupled to a drive shaft 174 of the gas separator assembly 126, and the drive shaft 174 is mechanically coupled to a drive shaft of the production pump assembly 128 and transfers rotational power to the drive shaft of the production pump assembly 128 and to impellers of the centrifugal pump stages of the production pump assembly 128. The several different drive shaft mechanical couplings may be provided by splines cut in the mating ends of shafts and coupled by a spline coupler or hub. In another embodiment, the drive shaft mechanical couplings may be provided by other devices.

In an embodiment, the charge pump assembly 125 comprises a fluid mover and zero fluid reservoirs. In an embodiment, the charge pump assembly 125 comprises a centrifugal pump 405 having an impeller 406 mechanically coupled to the drive shaft 172 of the charge pump assembly 125 (e.g., the impeller is coupled by a keyway of the impeller to a keyway of the drive shaft 172 by a shear key) and a diffuser 408 retained by a housing of the charge pump assembly 125. In an embodiment, the charge pump assembly 125 comprises a centrifugal pump having a plurality of pump stages 405 where each pump stage 405 comprises an impeller 406 mechanically coupled to the drive shaft 172 of the charge pump assembly 125 and a diffuser 408 retained by a housing of the charge pump assembly 125.

Figure 3:
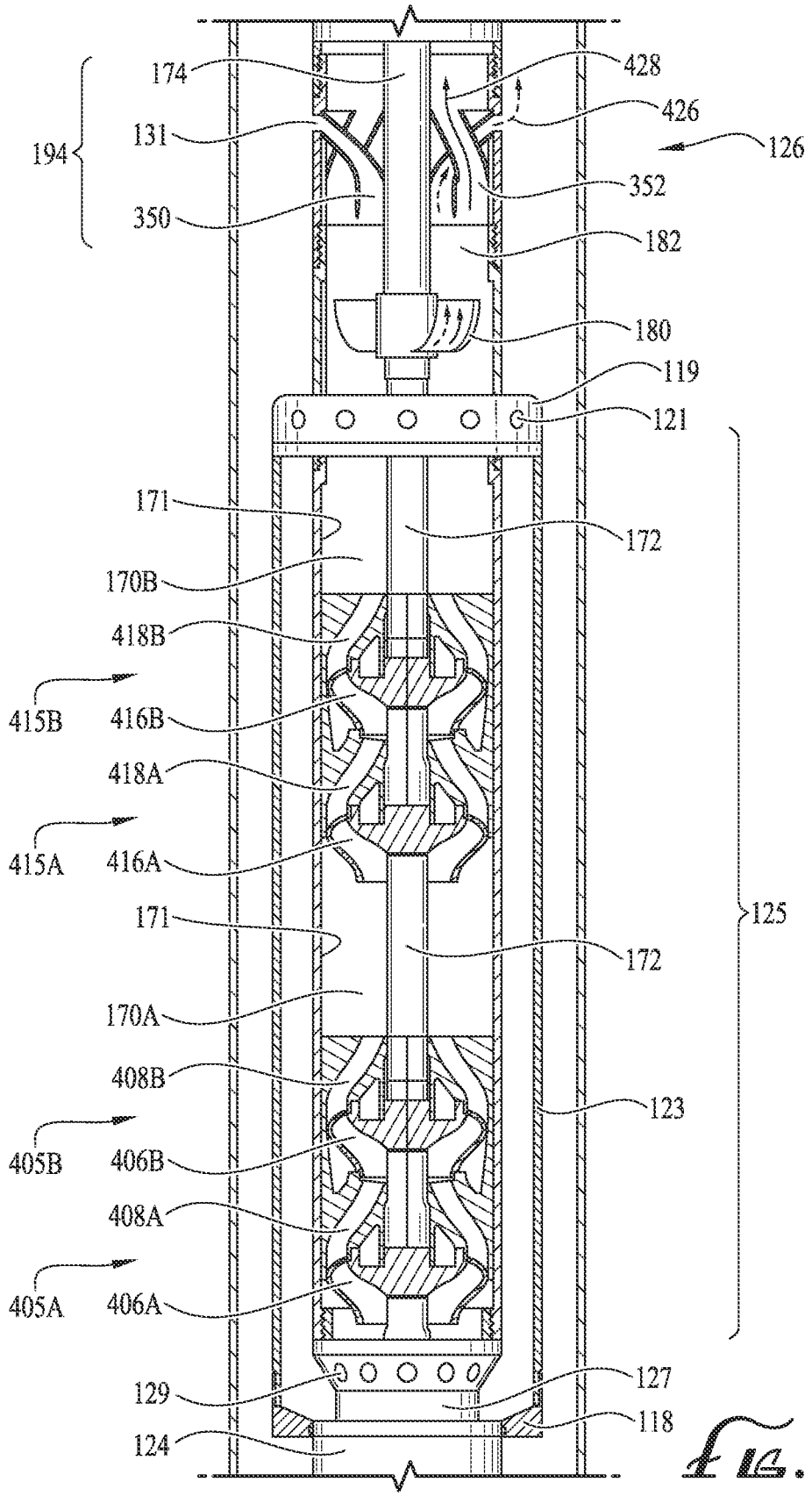
FIG. 3 is an illustration of another charge pump assembly according to an embodiment of the disclosure.

Turning now to FIG. 3, another embodiment of the charge pump assembly 125 is described. In FIG. 3, the charge pump assembly 125 is illustrated as having a first centrifugal pump comprising two centrifugal pump stages 405A, 405B and a second centrifugal pump comprising two centrifugal pump stages 415A, 415B. The third centrifugal pump stage 415A comprises a third impeller 416A coupled to the drive shaft 172 and a third diffuser 418A retained by the housing of the charge pump assembly 125. The fourth centrifugal pump stage 4158 comprises a fourth impeller 416B coupled to the drive shaft 172 and a fourth diffuser 418B retained by the housing of the charge pump assembly 125.

The charge pump assembly 125 illustrated in FIG. 3 comprises a first fluid reservoir 170A located between the centrifugal pump stages 405A, 4058 and the centrifugal pump stages 415A, 415E and a second fluid reservoir 170B located downstream of the centrifugal pump stages 415A, 415B. The first fluid reservoir 170A and the second fluid reservoir 170B may be substantially similar to the fluid reservoir 170 described above with reference to FIG. 2. In an embodiment, interpolating fluid reservoirs 170 between centrifugal pump stages may contribute to a desired mixing of gas phase fluid with liquid phase fluid that is fed into the gas separator assembly 126. In an embodiment, the charge pump assembly 125 may comprise any number of centrifugal pumps (each comprising 1 or more centrifugal pump stages) and any number of fluid reservoirs 170. By increasing the number of fluid reservoirs 170, the length of time that the ESP assembly 132 may sustain a gas slug without the production pump assembly experiencing problems (e.g., becoming gas locked or experiencing bearing damage) may be extended.

With reference now to both FIG. 2 and FIG. 3, the fluid reservoir(s) 170 may retain mostly liquid phase fluid when the ESP assembly 132 is experiencing normal operating conditions (e.g., when the electric motor 122 is energized and turning, when reservoir fluid 142 that is mostly liquid phase fluid is entering the wellbore 102; when the inside of the inverted shroud 123 is filled with mostly liquid phase fluid, and the primarily liquid phase fluid is flowing in the intake ports 129, and in the absence of a gas slug); and this liquid phase fluid can be mixed progressively with gas when the ESP assembly 132 receives a gas slug to extend the time that the gas separator assembly 126 is able to continue to supply at least some liquid phase fluid to the production pump assembly 128.

For example, at a first point in time, before the gas slug fills the inside of the inverted shroud 123 and arrives at the intake ports 129, the outlet of the charge pump assembly 125 (e.g., the downstream end of the fluid reservoir 170 in the embodiment of FIG. 2 or the downstream end of the fluid reservoir 170B in the embodiment of FIG. 3) may provide fluid having a first gas liquid ratio (GLR) to the inlet of the gas separator assembly 126. As gas from the gas slug fills the interior of the inverted shroud 123 and enters the intake ports 129, at a second point in time (after the first point in time) the gas mixes with the fluid in the fluid reservoir 170, and the outlet of the charge pump assembly 125 may provide fluid having a second GLR to the inlet of the gas separator assembly 126, where the second GLR is greater than the first GLR. At a third point in time (after the second point in time) the gas continues to mix with the fluid in the fluid reservoir 170, and the outlet of the charge pump assembly 125 may provide fluid having a third GLR to the inlet of the gas separator assembly 126, where the third GLR is greater than the second GLR. At a fourth point in time (after the third point in time), when the gas slug passes the ESP assembly 132, and primarily liquid phase fluid is entering the interior of the inverted shroud 123, the reservoir fluid 142 entering the intake ports 129 may again be primarily liquid phase fluid, and the outlet of the charge pump assembly 125 may provide fluid having a fourth GLR to the inlet of the gas separator assembly 126, where the fourth GLR is less than the third GLR. At a fifth point in time (after the fourth point in time), when the interior of the inverted shroud 123 is feeding mostly liquid phase fluid to the intake ports 129, the outlet of the charge pump assembly 125 may provide fluid having a fifth GLR to the inlet of the gas separator assembly 126, where the fifth GLR is less than the fourth GLR and approximately equal to the first GLR. It is noted that without the primarily liquid phase fluid retained in the interior of the inverted shroud 123 and retained in the fluid reservoirs) 170 at the time that the gas slug arrived at the ESP assembly 132 and the intake ports 129 (e.g., if there were no fluid reservoir 170 within the charge pump assembly 125), the GLR would have risen very quickly and would have flowed gas unmixed from the outlet of the diffuser 408B or of the diffuser 418B, from the outlet of the diffuser 408B or 418E to the inlet of the gas separator 126, and from the liquid phase discharge channel 352 to the inlet of the production pump assembly 128, with the undesirable effect that the bearings of the production pump assembly 128 would lose lubrication, would rapidly heat up, would rapidly degrade, and likely would leave the centrifugal pump stages in the production pump assembly 128 in a gas lock situation.

Figure 4:
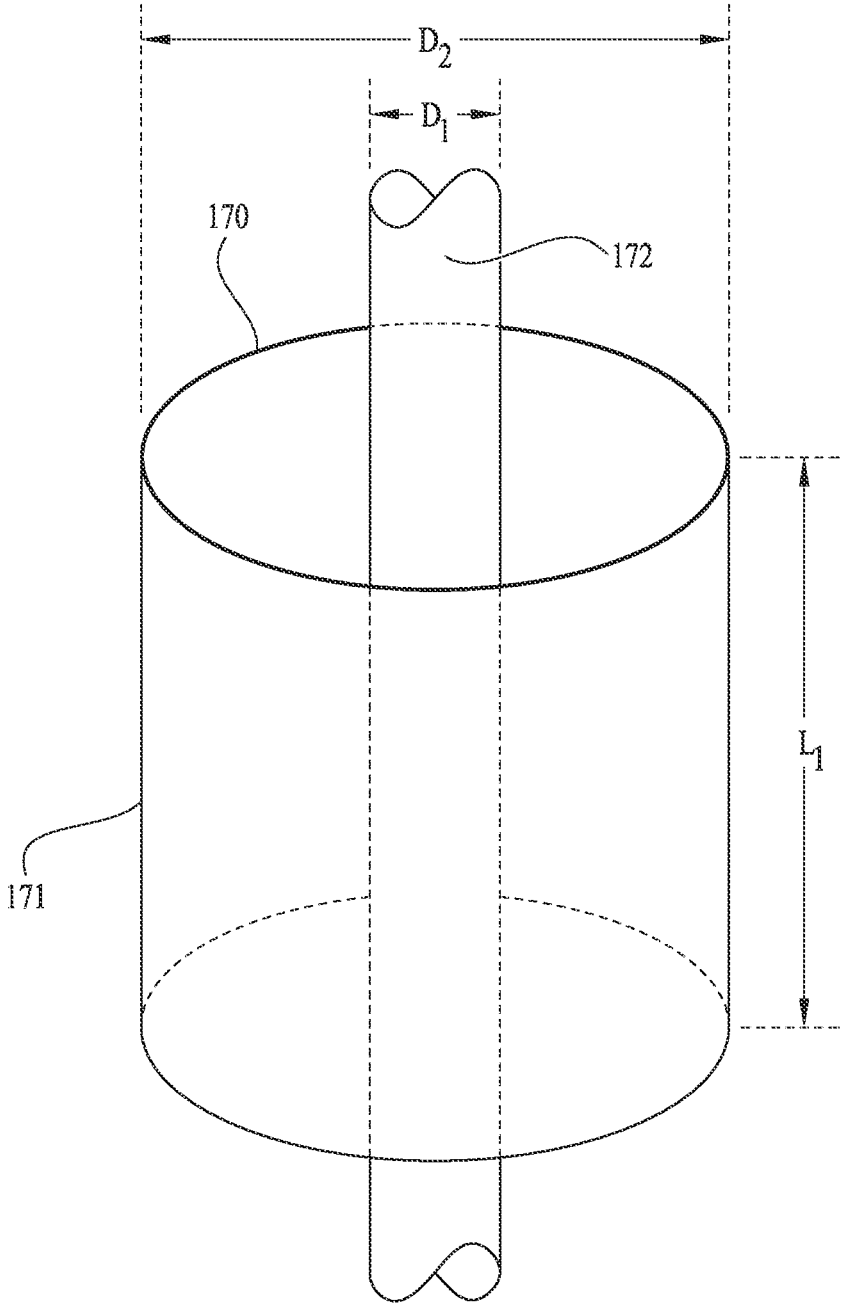
FIG. 4 is an illustration of an annulus in an interior of the charge pump assembly according to an embodiment of the disclosure.
Figure 5A:
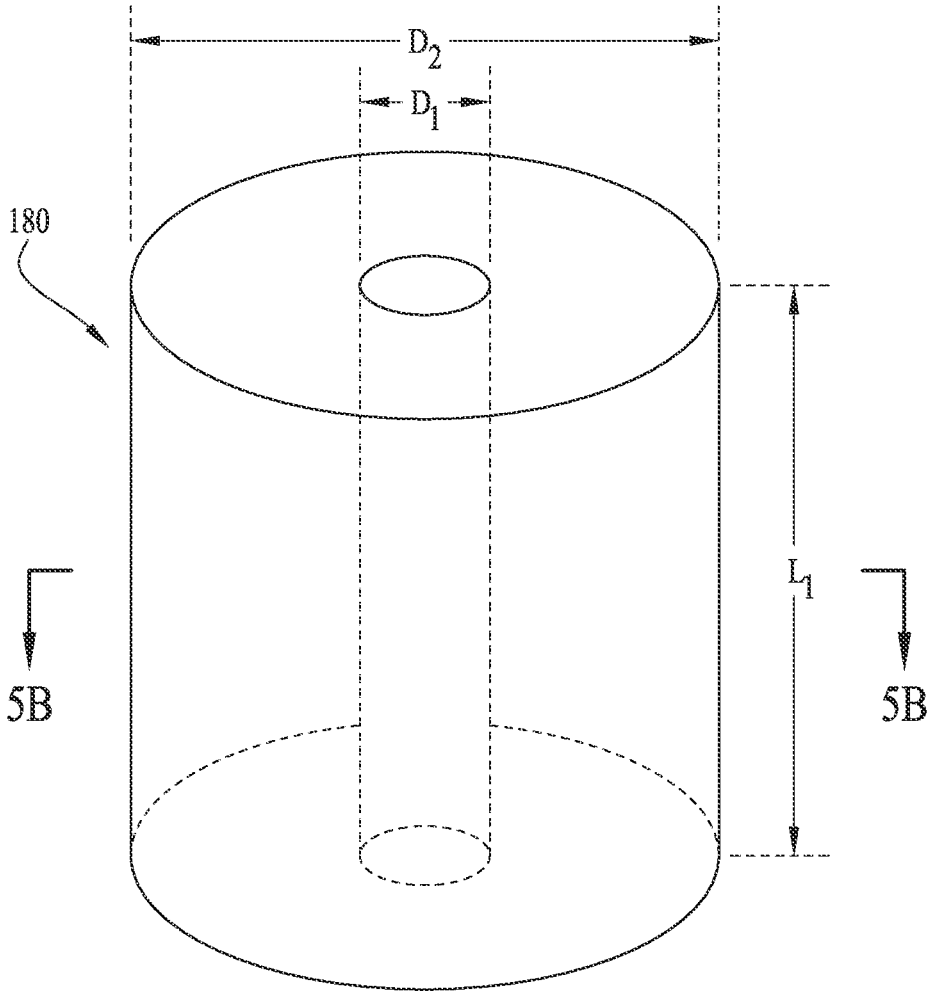
FIG. 5A is an illustration of an annular volume corresponding to the annulus in the interior of the charge pump assembly of FIG. 4.
Figure 5B:
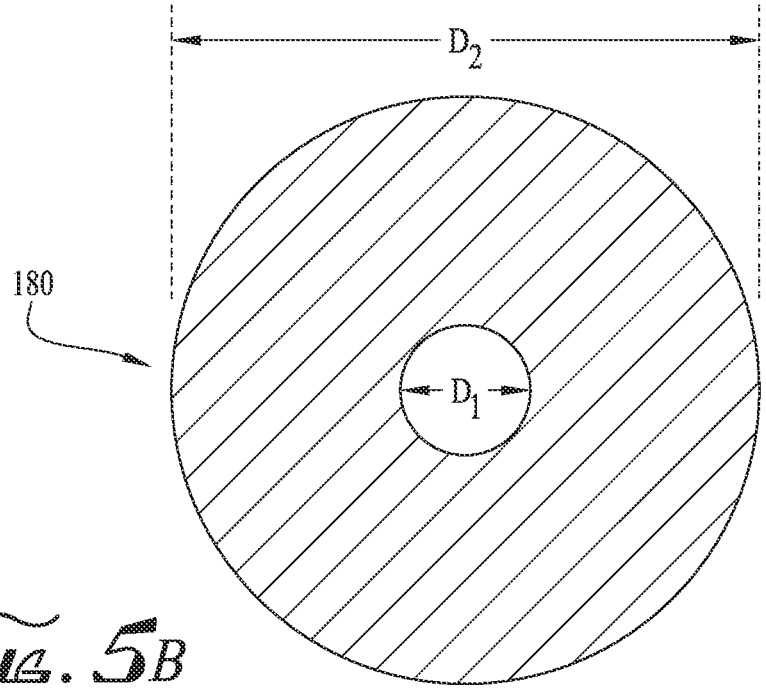
FIG. 5B is an illustration of a cross-sectional area of the annular volume of FIG. 5A.

Turning now to FIG. 4, the fluid reservoir 170 is illustrated as an annulus defined between the drive shaft 172 and the inner surface 171 of the housing of the charge pump assembly 125. The annular volume of the annulus defined by the fluid reservoir is shown better in FIG. 5A and FIG. 58. The volume may be found as the cross-sectional area of the annular volume 180 (best seen in FIG. 5B) multiplied by the length of the fluid reservoir 170 indicated as 'L1' in FIG. 4 and in FIG. 5A. The cross-sectional area of the annular volume 180 can be found as the difference of the area of a circle of diameter D2 (the inside diameter of the housing 312 or the inside diameter of the sleeve) and the area of a circle of diameter D1 (the diameter of the drive shaft 172). By increasing the sum volume of fluid reservoirs inside the charge pump assembly 125 the gas separator assembly 126 is able to sustain gas slugs of increasing duration (e.g., is able to continue to supply at least some liquid phase fluid to the inlet of the production pump assembly 128).

In an embodiment; the fluid reservoir 170 is at least 2 inches long and less than 14 inches long. In an embodiment, the fluid reservoir 170 is at least 6 inches long and less than 14 inches long. In an embodiment, the fluid reservoir 170 is at least 14 inches long and less than 28 inches long. In an embodiment, the fluid reservoir 170 is at least 17 inches long and less than 34 inches long. In an embodiment, the fluid reservoir 170 is at least 24 inches long and less than 42 inches long. In an embodiment, the annular volume 180 of the fluid reservoir 170 is at least 18 cubic inches and less than 1000 cubic inches. In an embodiment, the annular volume 180 of the fluid reservoir 170 is at least 50 cubic inches and less than 1000 cubic inches. In an embodiment, the fluid reservoir 170 may comprise one or more spider bearings to support the drive shaft 172 as discussed further hereinafter.

In an embodiment, the charge pump assembly 125 may be less than 500 feet long and at least, 5 feet long; at least 8 feet long, at least 10 feet long, at least 12 feet long, at least 14 feet long, at least 16 feet long, at least 18 feet long, at least 20 feet long, at least 22 feet long, at least 24 feet long, at least 26 feet long, at least 28 feet long, at least 30 feet long, at least 32 feet long, at least 34 feet long, at least 40 feet long, at least 50 feet long, at least 60 feet long, at least 70 feet long, at least 80 feet long, at least 90 feet long, at least 100 feet long, at least 120 feet long, or at least 140 feet long. With long charge pump assemblies 125, the charge pump assembly 125 may comprise a first housing that threadingly couples with a second housing, and the first housing and second housing joined together contain a plurality of centrifugal pump stages and a plurality of fluid reservoirs of the charge pump assembly 125. With long charge pump assemblies 125, the drive shaft 172 may comprise two or more drive shafts that are coupled together by a spline coupling.

In an embodiment, during normal operation (e.g., there is no gas slug present at the intake ports 129), liquid phase fluid may fill an annulus between the outside of the ESP assembly 132 and an inside of the wellbore 102 or casing 104 from fluid intake 127 to the gas discharge ports 131. This liquid phase fluid may also mix with gas at the intake ports 129 and in the centrifugal pump stages 405 when a gas slug hits the ESP assembly 132. Thus, the longer the combination of the charge pump assembly 125 and the gas separator assembly 126, the larger the volume of liquid phase fluid retained in the annulus and the longer the ESP assembly 132 can sustain a gas slug while still feeding some liquid phase fluid to the production pump assembly 128. Thus, extending the length of the charge pump assembly 125 with fluid reservoirs 170, 174, 176 also may create additional liquid fluid reserves in the annulus between the outside of the ESP assembly 132 and the inside of the wellbore 102 or casing 104.

Figure 6A:
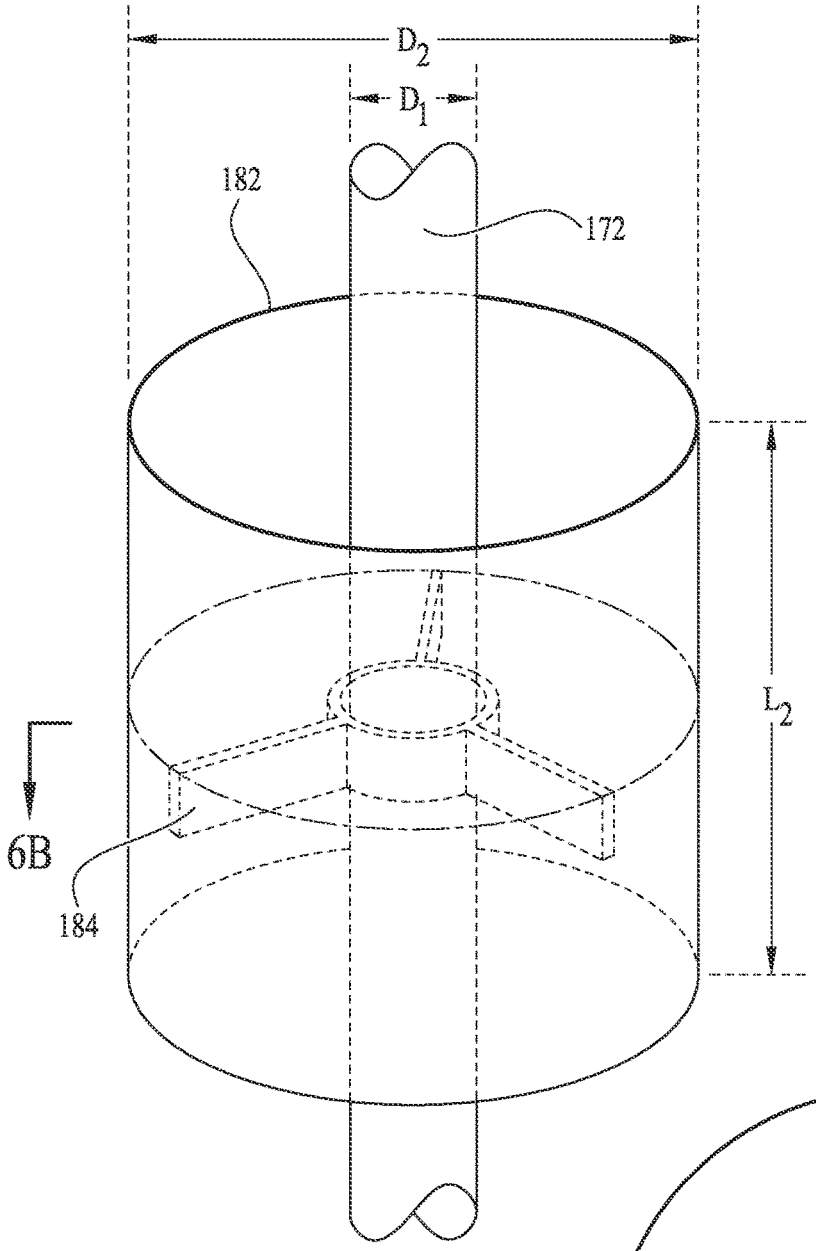
FIG. 6A is an illustration of another annulus and a spider bearing in an interior of the charge pump assembly according to an embodiment of the disclosure.
Figure 6B:
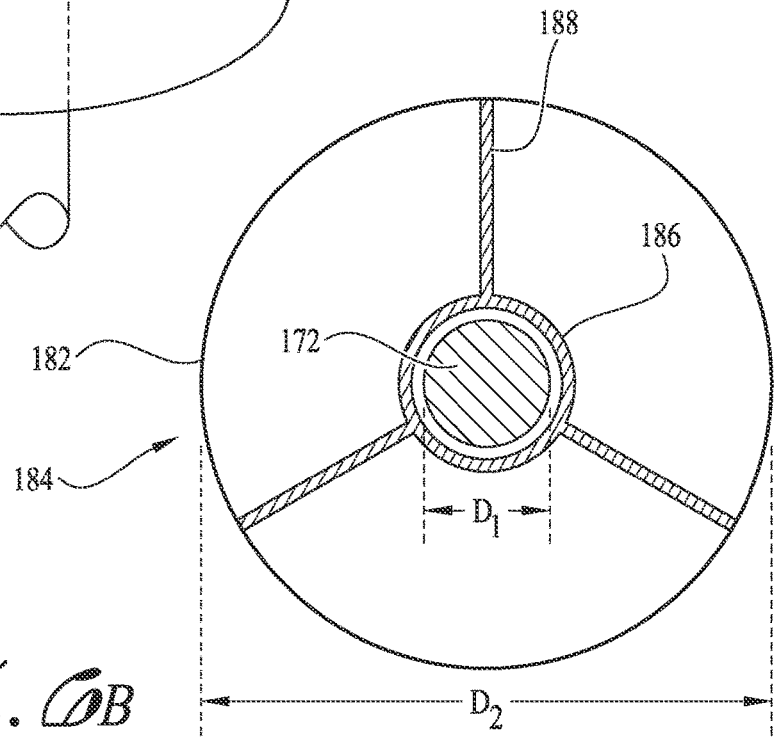
FIG. 6B is an illustration of a cross-section of the spider bearing according to an embodiment of the disclosure.
Figure 6C:
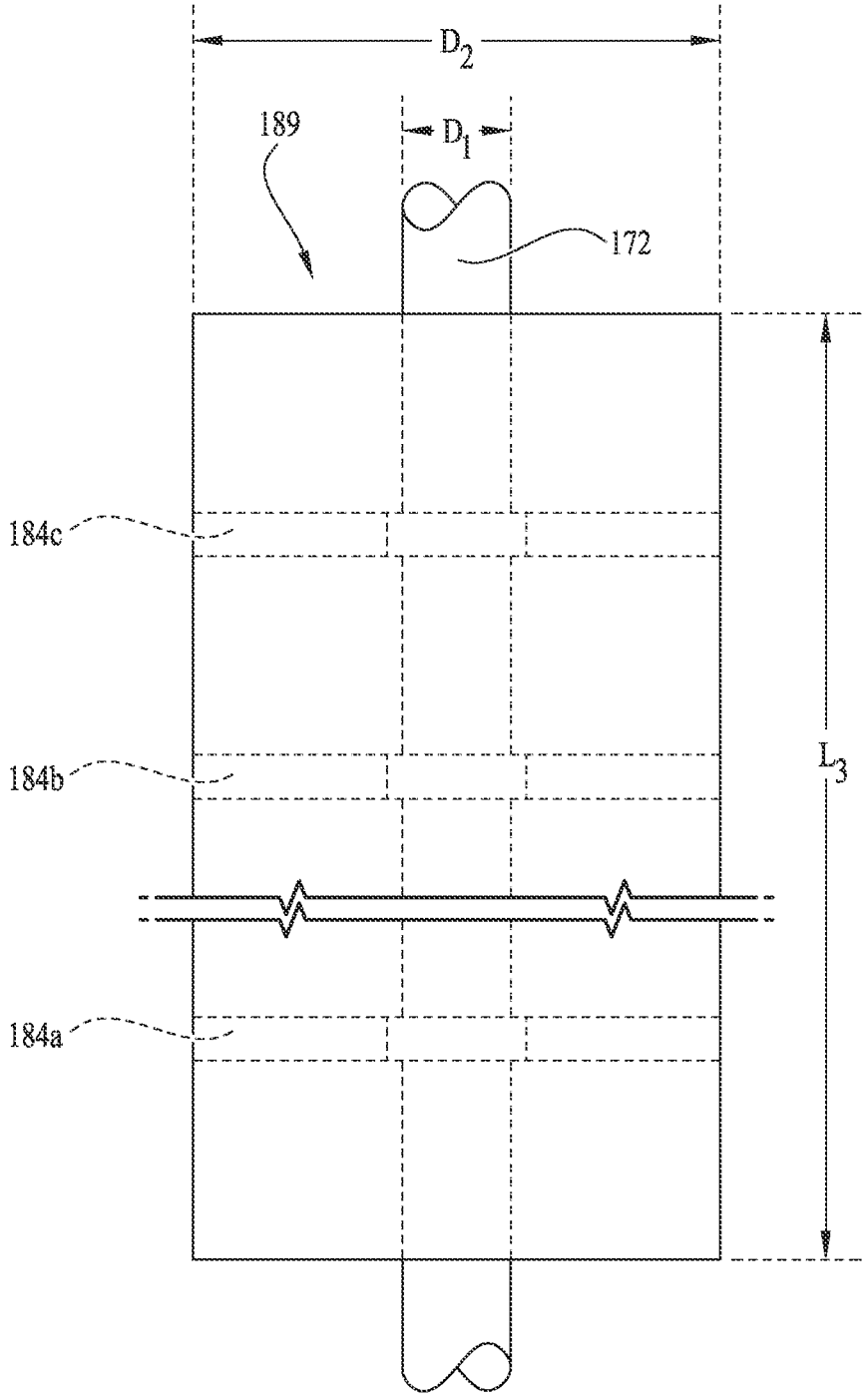
FIG. 6C is an illustration of yet another annulus and a plurality of spider bearings in an interior of the charge pump assembly according to an embodiment of the disclosure.

Turning now to FIG. 6A, an annular volume 182 is illustrated. A spider bearing 184 is illustrated in about a middle of the length L2 of the annular volume 182. By supporting the drive shaft 172 in a middle portion, the length L2 can be made greater, for example can be increased to 16 inches, 18 inches, 20 inches, 22 inches, 24 inches, 26 inches, or 28 inches. The use of spider bearings 184 can readily increase the sum of volumes of one or more fluid reservoir within the charge pump assembly 125. In FIG. 6B a different view of the spider bearing 184 is illustrated. The spider bearing 184 may comprise three struts 188 that stabilize a central bearing 186 of the spider bearing 184. The struts 188 may be secured by the inside of the housing of the charge pump assembly 125. The struts 188 may take a shape of vanes oriented so as to minimally block the communication of reservoir fluid 142 through the spider bearing 184, between the struts 188. The spider bearing 184 provides fluid communication paths between the struts 188. While FIG. 6A and FIG. 6B illustrate a spider bearing 184 with three struts 188, the spider bearings 184 may comprise two struts, four struts, five struts, or some greater number of struts 188. In FIG. 6C, the number of spider bearings 184 may be increased to any number, thereby increasing the total annular volume defined by the fluid reservoirs) 170. As shown in FIG. 6C, three spider bearings 184*a*, 184*b*, 184*c* are used and may provide a length L3 of the fluid reservoir (s) 170 of 24 inches, 32, inches, 40 inches, 44 inches, 48 inches, 52 inches, or 56 inches.

In an embodiment, the drive shaft 172 has an outside diameter of about ⅞ inches (e.g., about 0.875 inches), and the gas separator assembly 126 has an outside diameter of about 4 inches. In this case, the inside diameter of the housing of the charge pump assembly 125 is about 3½ inches (e.g., 3.5 inches). These dimensions give a D1 value of about 0.875 inches, a D2 value of about 3.5 inches. The area of the cross-section in FIG. 5B for these values of D1 and D2 can be calculated to be about 9.0198 square inches. A corresponding annular volume can be calculated for a plurality of different values for L1 as per below:

| Value of L1 | Corresponding annular volume |
|---|---|
| 2" | 18.040 cubic inches |
| 4" | 36.079 cubic inches |
| 6" | 54.119 cubic inches |
| 8" | 72.158 cubic inches |
| 10" | 90.198 cubic inches |
| 12" | 108.24 cubic inches |
| 14" | 126.28 cubic inches |

In an embodiment, the drive shaft 172 has an outside diameter of about 11/16 inches (e.g., about 0.6875 inches), and the gas separator assembly 126 has an outside diameter of about 4 inches. In this case, the inside diameter of the housing of the charge pump assembly 125 is about 3½ inches (e.g., 3.5 inches). The area of the cross-section in FIG. 5B for these values of D1 and D2 can be calculated to be about 9.2499 square inches. A corresponding annular volume can be calculated for a plurality of different values for L1 as per below:

| Value of L1 | Corresponding annular volume |
|---|---|
| 2" | 18.500 cubic inches |
| 4" | 37.000 cubic inches |
| 6" | 55.499 cubic inches |
| 8" | 73.999 cubic inches |
| 10" | 92.499 cubic inches |
| 12" | 111.00 cubic inches |
| 14" | 129.50 cubic inches |

In an embodiment, the drive shaft 172 has an outside diameter of about 1 3/16 inches (e.g., about 1.1875 inches), and the charge pump assembly 125 has an outside diameter of about 5.38 inches. In this case, the inside diameter of the housing of the charge pump assembly 125 is about 4.77 inches. The area of the cross-section in FIG. 5B for these values of D1 and D2 can be calculated to be about 16.763 square inches. A corresponding annular volume can be calculated for a plurality of different values for L1 as per below:

| Value of L1 | Corresponding annular volume |
|---|---|
| 2" | 33.526 cubic inches |
| 4" | 67.052 cubic inches |
| 6" | 100.58 cubic inches |
| 8" | 134.10 cubic inches |
| 10" | 167.63 cubic inches |
| 12" | 201.16 cubic inches |
| 14" | 234.68 cubic inches |

in an embodiment, the drive shaft 172 has an outside diameter of about 1 inch, and the charge pump assembly 125 has an outside diameter of about 5.38 inches. In this case, the inside diameter of the housing of the charge pump assembly 125 is about 4.77 inches. The area of the cross-section in FIG. 5B for these values of D1 and D2 can be calculated to be about 17.085 square inches. A corresponding annular volume can be calculated for a plurality of different values for L1 as per below:

| Value of L1 | Corresponding annular volume |
|---|---|
| 2" | 34.170 cubic inches |
| 4" | 68.340 cubic inches |
| 6" | 102.51 cubic inches |
| 8" | 136.68 cubic inches |
| 10" | 170.85 cubic inches |
| 12" | 205.02 cubic inches |
| 14" | 239.19 cubic inches |

The diameter of the drive shaft 172 and the inside diameter of the housing of the charge pump assembly 125 may be determined by the wellbore environment the ESP assembly 132 may be deployed to. By varying the length L1, however, more or less annular volume may be created in the fluid reservoir 170. More annular volume provides further buffer or reserve against gas slugs. At the same time, the length L1 may not be increased indefinitely because the drive shaft 172 may be unsupported and unstabilized in the fluid reservoir 170. In an embodiment, this length L1 may desirably be restricted to less than 16 inches, less than 15 inches, less than 14 inches, less than 13 inches, less than 12 inches, less than 11 inches, or less than 10 inches. The maximum prudent length of L1 depends upon the diameter of the drive shaft 172—the value of D1. A greater diameter drive shaft 172 may allow a relatively larger maximum length of L1 while a smaller diameter drive shaft 172 may allow a relatively smaller maximum length of L1. Greater annular volume—and hence greater ability to sustain gas slugs of long duration—can be provided either by increasing the length L1 or by increasing the number of fluid reservoirs within the gas separator assembly 126. Greater annular volume can be provided by increasing the length L1 by adding spider bearings 184 and desirable intervals within a single fluid reservoir to maintain the desired stability and support for the drive shaft 172.

It is noted that the substantial open volumes within a charge pump assembly 125 taught herein are not conventionally provided in charge pump assemblies because additional materials are required to do this (longer housing of the charge pump assembly 125, for example), and longer spans where the drive shaft 172 is not supported occur.

Figure 7A:
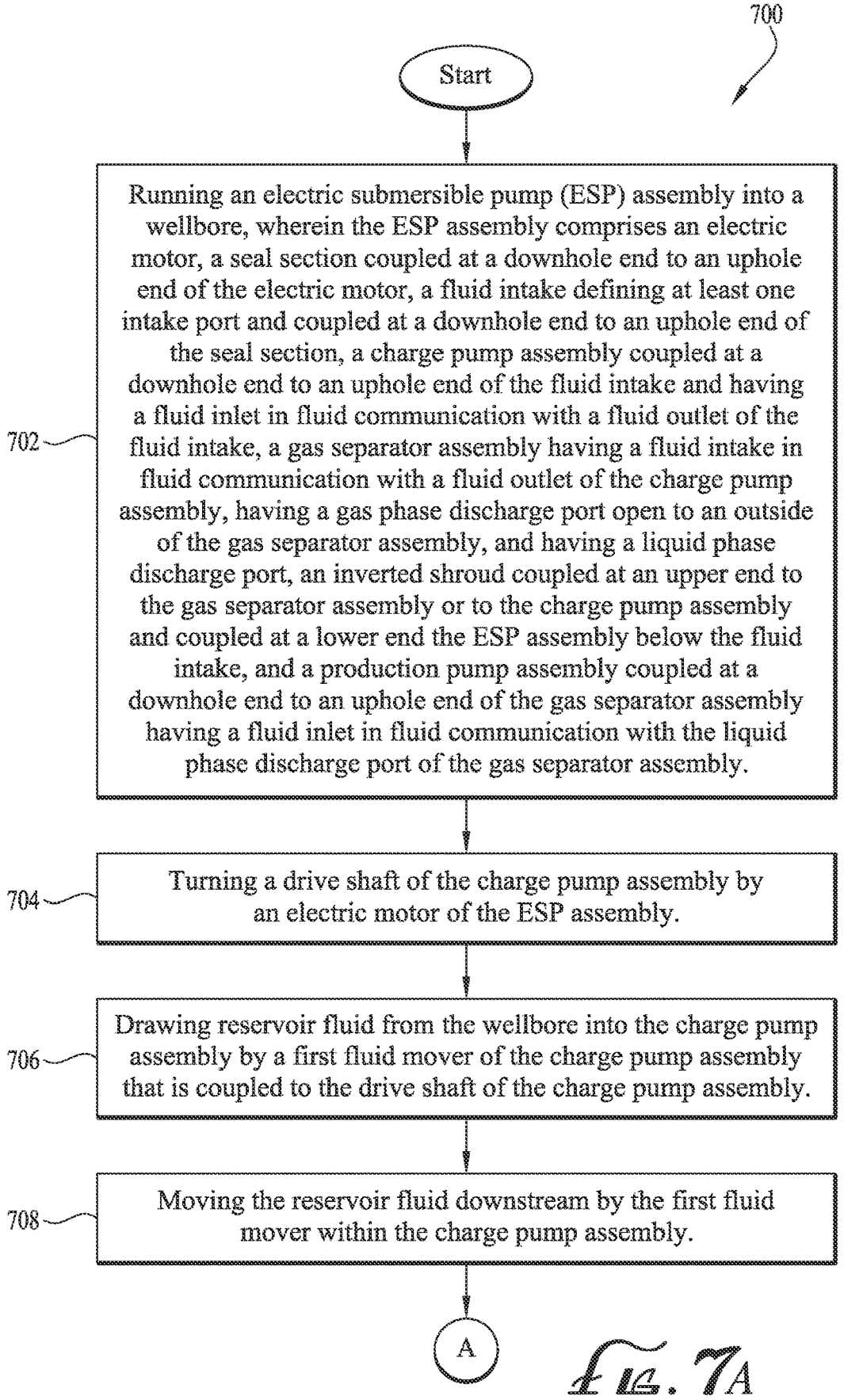
FIG. 7A and FIG. 7B is a flow chart of a method according to an embodiment of the disclosure.
Figure 7B:
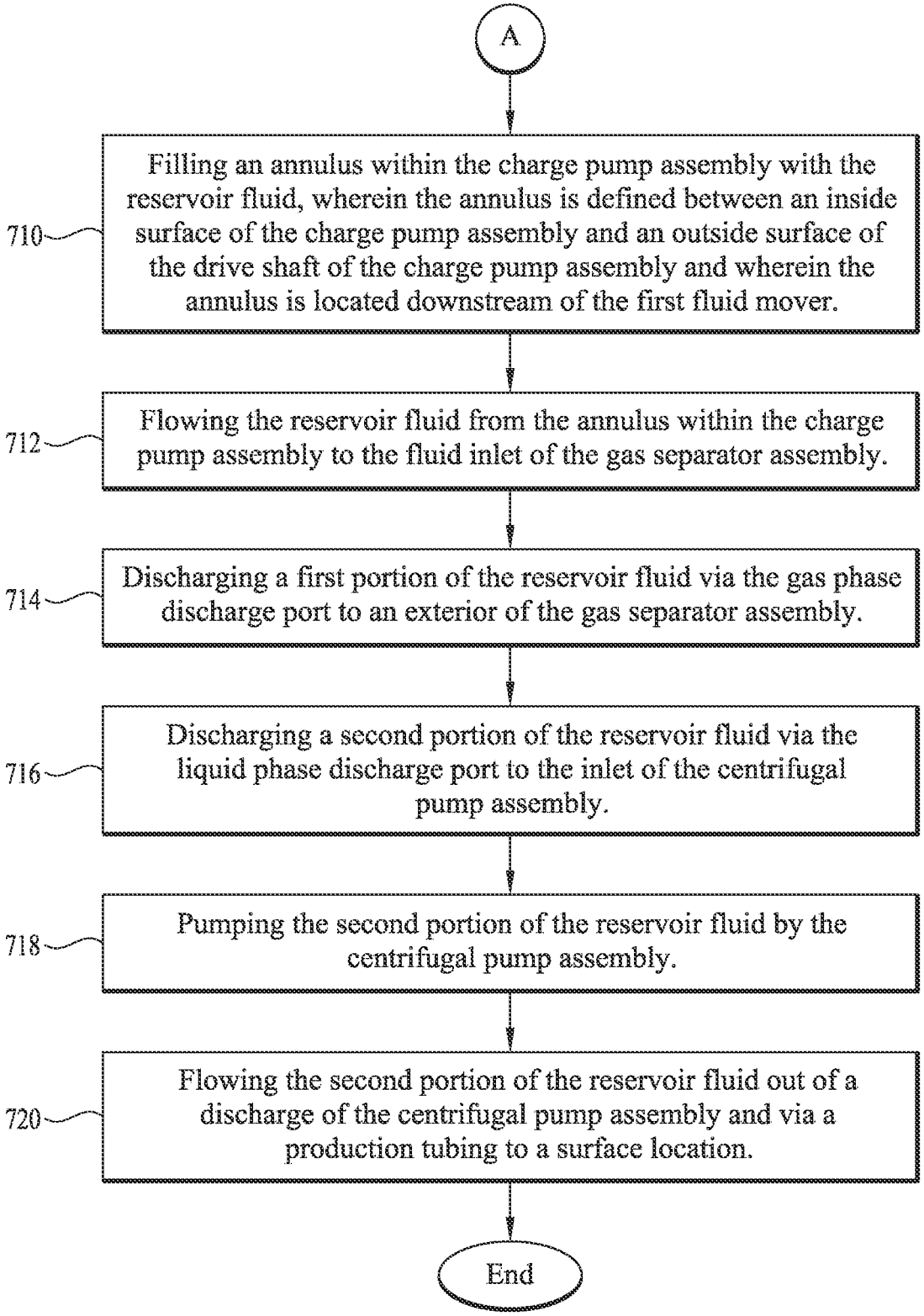

Turning now to FIG. 7A and FIG. 7B, a method 700 is described. In an embodiment, the method 700 is a method of lifting liquid in a wellbore. At block 702, the method 700 comprises running an electric submersible pump (ESP) assembly into a wellbore, wherein the ESP assembly comprises an electric motor, a seal section coupled at a downhole end to an uphole end of the electric motor, a fluid intake defining at least one intake port and coupled at a downhole end to an uphole end of the seal section, a charge pump assembly coupled at a downhole end to an uphole end of the fluid intake and having a fluid inlet in fluid communication with a fluid outlet of the fluid intake, a gas separator assembly having a fluid intake in fluid communication with a fluid outlet of the charge pump assembly, having a gas phase discharge port open to an outside of the gas separator assembly, and having a liquid phase discharge port, an inverted shroud coupled at an upper end to the gas separator assembly or to the charge pump assembly and coupled at a lower end the ESP assembly below the fluid intake, and a production pump assembly coupled at a downhole end to an uphole end of the gas separator assembly having a fluid inlet in fluid communication with the liquid phase discharge port of the gas separator assembly.

At block 704, the method 700 comprises turning a drive shaft of the charge pump assembly by an electric motor of the ESP assembly, At block 706, the method 700 comprises drawing reservoir fluid from the wellbore into the charge pump assembly by a first fluid mover of the charge pump assembly that is coupled to the drive shaft of the charge pump assembly. At block 708, the method 700 comprises moving the reservoir fluid downstream by the first fluid mover within the charge pump assembly. In an embodiment, the first fluid mover comprises one or more centrifugal pump stages, wherein each pump stage comprises an impeller coupled to the drive shaft of the charge pump assembly and a diffuser retained by a housing of the charge pump assembly. In an embodiment, the first fluid mover is an auger coupled to the drive shaft of the charge pump assembly.

At block 710, the method 700 comprises filling an annulus within the charge pump assembly with the reservoir fluid, wherein the annulus is defined between an inside surface of the charge pump assembly (e.g., an inside surface of a housing of the charge pump assembly) and an outside surface of the drive shaft of the charge pump assembly and wherein the annulus is located downstream of the first fluid mover. In an embodiment, a volume of the annulus is at least 50 cubic inches and less than 1000 cubic inches. At block 712, the method 700 comprises flowing the reservoir fluid from the annulus within the charge pump assembly to the fluid inlet of the gas separator assembly. In an embodiment, the charge pump assembly comprises a second fluid mover downstream of the annulus, wherein the second fluid mover comprises one or more centrifugal pump stages and wherein each pump stage comprises an impeller coupled to the drive shaft of the charge pump assembly and a diffuser retained by a housing of the charge pump assembly. In an embodiment, the second fluid mover is an auger coupled to the drive shaft of the charge pump assembly. In an embodiment, the processing of block 712 further comprises flowing the reservoir fluid from the annulus within the charge pump assembly to the second fluid mover and from the second fluid mover to the fluid inlet of the gas separator assembly. In an embodiment, the charge pump assembly comprises a second annulus downstream of the second fluid mover, and the processing of block 712 further comprises flowing the reservoir fluid from the second fluid mover to the second annulus, and from the second annulus to the fluid inlet of the gas separator assembly. The second annulus is defined between an inside surface of the charge pump assembly (e.g., an inside surface of a housing of the charge pump assembly) and an outside surface of the drive shaft of the charge pump assembly.

At block 714, the method 700 comprises discharging a first portion of the reservoir fluid via the gas phase discharge port to an exterior of the gas separator assembly. At block 716, the method 700 comprises discharging a second portion of the reservoir fluid via the liquid phase discharge port to the inlet of the production pump assembly. At block 718, the method 700 comprises pumping the second portion of the reservoir fluid by the production pump assembly. At block 720, the method 700 comprises flowing the second portion of the reservoir fluid out of a discharge of the production pump assembly and via a production tubing to a surface location.

In an embodiment, the method 700 further comprises (for example during a transient gas slug impinging upon the ESP assembly) drawing gas from the wellbore into the gas separator by the first fluid mover; flowing the gas downstream by the first fluid mover to the annulus within the charge pump assembly; mixing the gas with reservoir fluid retained by the annulus within the charge pump assembly to form a mix of gas and fluid; and flowing the mix of gas and fluid from the annulus within the charge pump assembly to the inlet of the gas separator assembly.

In an embodiment, the method 700 further comprises stabilizing the drive shaft by a spider bearing that is concentric with the drive shaft and that is located inside the annulus within the charge pump assembly, wherein the spider bearing provides flow paths for the reservoir fluid between struts of the spider bearing. In an embodiment, the method 700 further comprises stabilizing the drive shaft by a plurality of spider bearings, wherein each spider bearing is concentric with the drive shaft, is located inside the annulus within the charge pump assembly, and provides flow paths for the reservoir fluid between struts of the spider bearing. In an embodiment comprising, each spider bearing is separated from the other spider bearing by at least 4 inches and less than 16 inches.

Figure 8A:
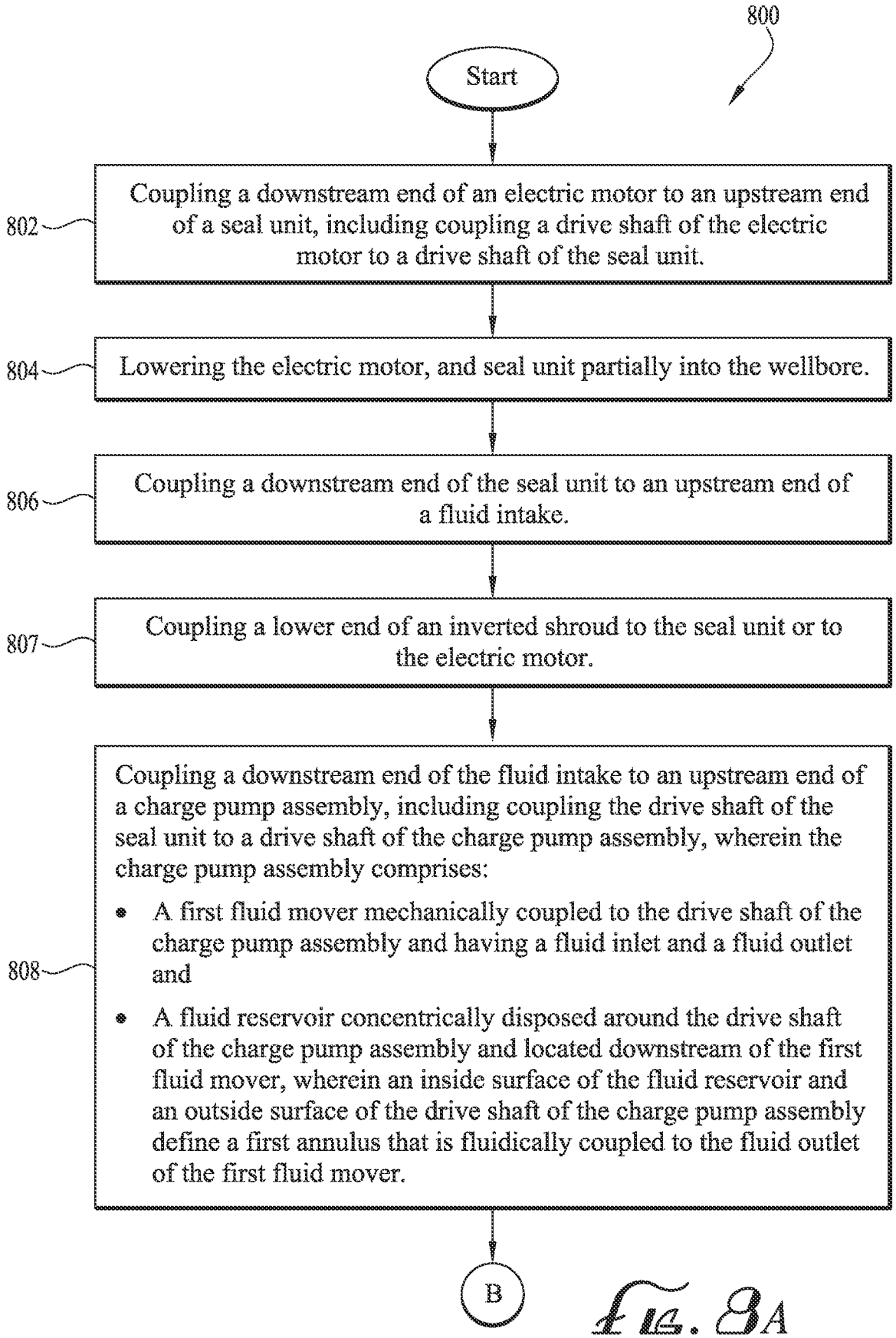
FIG. 8A and FIG. 8B is a flow chart of another method according to an embodiment of the disclosure.
Figure 8B:
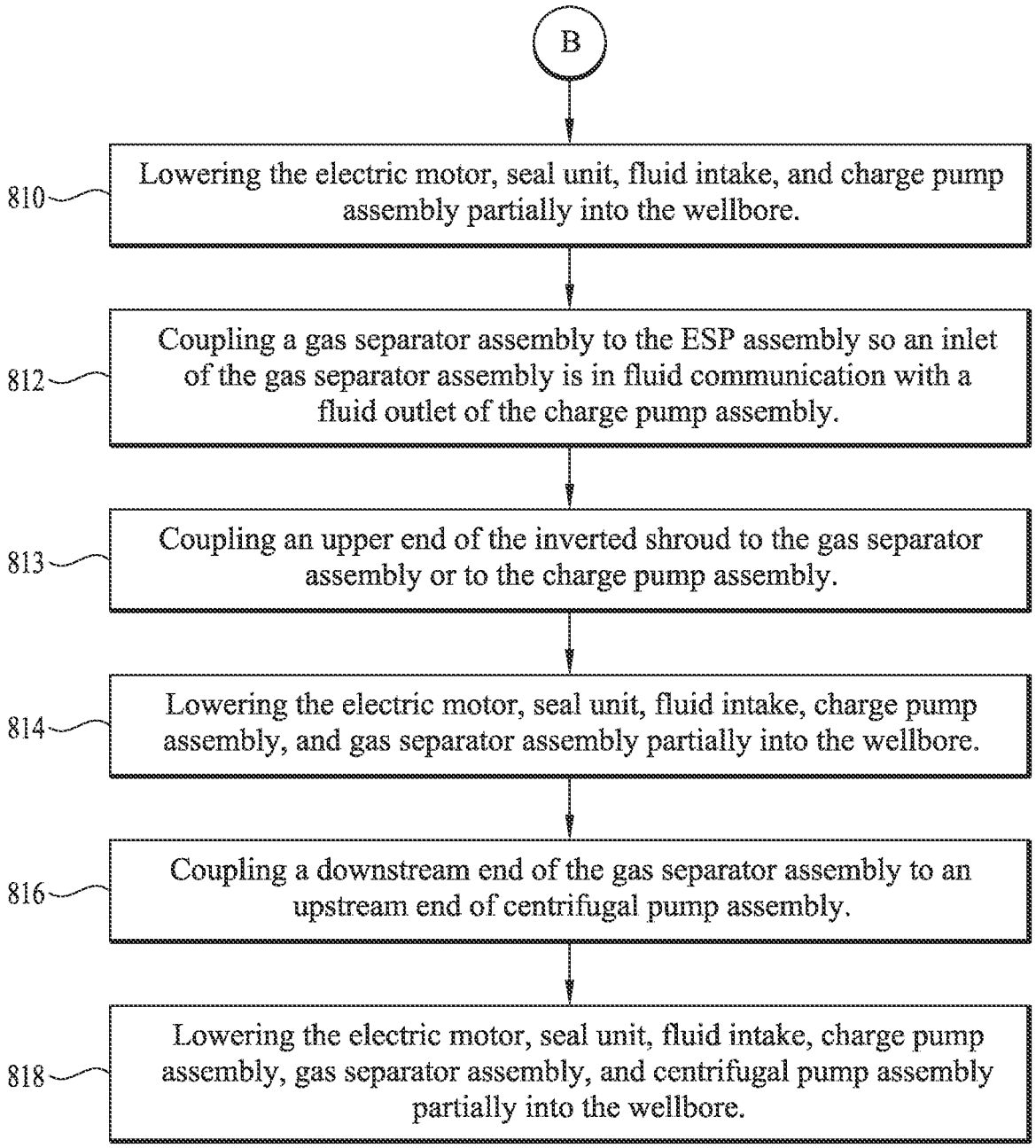

Turning now to FIG. 8A and FIG. 8B, a method 800 is described. In an embodiment, the method 800 is a method of assembling an electric submersible pump (ESP) assembly at a wellbore location. At block 802, the method 800 comprises coupling a downstream end of an electric motor to an upstream end of a seal unit, including coupling a drive shaft of the electric motor to a drive shaft of the seal unit. At block 804, the method 800 comprises lowering the electric motor, and seal unit partially into the wellbore. At block 806, the method 800 comprises coupling a downstream end of the seal unit to an upstream end of a fluid intake. At block 807, the method 800 comprises coupling a lower end of an inverted shroud to the seal unit or to the electric motor.

At block 808, the method 800 comprises coupling a downstream end of the fluid intake to an upstream end of a charge pump assembly, including coupling the drive shaft of the seal unit to a drive shaft of the charge pump assembly, wherein the charge pump assembly comprises a first fluid mover mechanically coupled to the drive shaft of the charge pump assembly and having a fluid inlet and a fluid outlet and a fluid reservoir concentrically disposed around the drive shaft of the charge pump assembly and located downstream of the first fluid mover, wherein an inside surface of the fluid reservoir and an outside surface of the drive shaft of the charge pump assembly define a first annulus that is fluidically coupled to the fluid outlet of the first fluid mover. In an embodiment, the first fluid mover comprises one or more centrifugal pump stages, wherein each pump stage comprises an impeller coupled to the drive shaft of the charge pump assembly and a diffuser retained by a housing of the charge pump assembly. In an embodiment, the first fluid mover is an auger coupled to the drive shaft of the charge pump assembly. In an embodiment, the charge pump assembly comprises a plurality of fluid reservoirs. In an embodiment, the charge pump assembly further comprises a spider bearing concentric with the drive shaft and located within the first fluid reservoir, wherein the spider bearing comprises struts that provide fluid communication paths between the struts. In an embodiment, the charge pump assembly comprises a second fluid mover mechanically coupled to the drive shaft of the charge pump assembly and having a fluid inlet fluidically coupled to an outlet of the fluid reservoir and a fluid outlet fluidically coupled to the inlet of the gas separator assembly. In an embodiment, the second fluid mover comprises one or more centrifugal pump stages, wherein each pump stage comprises an impeller coupled to the drive shaft of the charge pump assembly and a diffuser retained by a housing of the charge pump assembly. In an embodiment, the second fluid mover s an auger coupled to the drive shaft of the charge pump assembly. At block 810, the method 800 comprises lowering the electric motor, seal unit, fluid intake, and charge pump assembly partially into the wellbore.

At block 812, the method 800 comprises coupling a gas separator assembly to the ESP assembly so an inlet of the gas separator assembly is in fluid communication with a fluid outlet of the charge pump assembly. At block 813, the method 800 comprises coupling an upper end of the inverted shroud to the gas separator assembly or to the charge pump assembly. At block 814, the method 800 comprises lowering the electric motor, seal unit, fluid intake, charge pump assembly, and gas separator assembly partially into the wellbore. At block 816, the method 800 comprises coupling a downstream end of the gas separator assembly to an upstream end of production pump assembly. At block 818, the method 800 comprises lowering the electric motor, seal unit, fluid intake, charge pump assembly, gas separator assembly, and production pump assembly partially into the wellbore.

Additional Disclosure

A first embodiment, which is an electric submersible pump (ESP) assembly, comprising an electric motor having a first drive shaft; a seal section coupled at a lower end to an upper end of the electric motor having a second drive shaft coupled to the first drive shaft; a fluid intake coupled at a lower end to an upper end of the seal section, wherein the fluid intake defines at least one intake port; a charge pump assembly coupled at a lower end to an upper end of the fluid intake having an inlet in fluid communication with a fluid outlet of the fluid intake, wherein the charge pump assembly comprises a third drive shaft coupled to the second drive shaft, a first fluid mover mechanically coupled to the third drive shaft and having a fluid inlet and a fluid outlet, a fluid reservoir concentrically disposed around the third drive shaft and located downstream of the first fluid mover, wherein an inside surface of the fluid reservoir and an outside surface of the third drive shaft define a first annulus that is fluidically coupled to the fluid outlet of the first fluid mover, a second fluid mover mechanically coupled to the third drive shaft and having a fluid inlet and a fluid outlet, wherein the second fluid mover is located downstream of the fluid reservoir, and wherein the fluid inlet of the second fluid mover is fluidically coupled to the first annulus; a gas separator assembly coupled at a downstream end to an upstream end of the charge pump assembly, having a fourth drive shaft coupled to the third drive shaft and having an inlet in fluid communication with an outlet of the charge pump assembly, having a gas flow path and liquid flow path separator having a gas phase discharge port open to an exterior of the gas separator assembly and a liquid phase discharge port; an inverted shroud coupled at an upper end to the gas separator assembly or to the charge pump assembly and coupled at a lower end to the ESP assembly below the fluid intake; and a production pump assembly coupled at a downstream end to an upstream end of the gas separator assembly and having an inlet in fluid communication with the liquid phase discharge port of the gas flow path and liquid flow path separator.

A second embodiment, which is the ESP assembly of the first embodiment, wherein the first annulus has a volume of at least 18 cubic inches and less than 1000 cubic inches.

A third embodiment, which is the ESP assembly of the first embodiment, wherein a distance between the fluid intake and the gas phase discharge port of the gas flow path and liquid flow path separator is at least 6 feet and less than 500 feet.

A fourth embodiment, which is the ESP assembly of first embodiment, wherein the fluid reservoir is at least 6 inches long and less than 17 inches long.

A fifth embodiment, which is the ESP assembly of any of the first through the fourth embodiment, further comprising a spider bearing located within the fluid reservoir that has a central through-hole that surrounds the drive shaft.

A sixth embodiment, which is the ESP assembly of the fifth embodiment, wherein the fluid reservoir is at least 17 inches long and less than 34 inches long.

A seventh embodiment, which is the ESP assembly of any of the first through the sixth embodiment, wherein the charge pump assembly further comprises a housing, wherein the inside surface of the fluid reservoir is provided by an inside surface of the housing, wherein the first fluid mover and the second fluid mover are located within the housing.

An eighth embodiment, which is the ESP assembly of any of the first through the seventh embodiment, wherein the first fluid mover comprises at least one centrifugal pump stage, wherein the at least one centrifugal pump stage comprises an impeller mechanically coupled to the third drive shaft and a diffuser retained by the housing.

A ninth embodiment, which is the ESP assembly of any of the first through the eighth embodiment, wherein the first fluid mover is an auger mechanically coupled to the third drive shaft.

A tenth embodiment, which is the ESP assembly of any of the first through the ninth embodiment, further comprising a second fluid reservoir concentrically disposed around the third drive shaft and located downstream of the second fluid mover, wherein an inside surface of the second fluid reservoir and an outside surface of the third drive shaft define a second annulus that is fluidically coupled to the fluid outlet of the second fluid mover.

An eleventh embodiment, which is a method of lifting liquid in a wellbore, comprising running an electric submersible pump (ESP) assembly into a wellbore, wherein the ESP assembly comprises an electric motor, a seal section coupled at a downhole end to an uphole end of the electric motor, a fluid intake defining at least one intake port and coupled at a downhole end to an uphole end of the seal section, a charge pump assembly coupled at a downhole end to an uphole end of the fluid intake and having a fluid inlet in fluid communication with a fluid outlet of the fluid intake, a gas separator assembly having a fluid intake in fluid communication with a fluid outlet of the charge pump assembly, having a gas phase discharge port open to an outside of the gas separator assembly, and having a liquid phase discharge port, an inverted shroud coupled at an upper end to the gas separator assembly or to the charge pump assembly and coupled at a lower end the ESP assembly below the fluid intake, and a production pump assembly coupled at a downhole end to an uphole end of the gas separator assembly having a fluid inlet in fluid communication with the liquid phase discharge port of the gas separator assembly; turning a drive shaft of the charge pump assembly by an electric motor of the ESP assembly; drawing reservoir fluid from the wellbore into the charge pump assembly by a first fluid mover of the charge pump assembly that is coupled to the drive shaft of the charge pump assembly; moving the reservoir fluid downstream by the first fluid mover within the charge pump assembly; filling an annulus within the charge pump assembly with the reservoir fluid, wherein the annulus is defined between an inside surface of the charge pump assembly and an outside surface of the drive shaft of the charge pump assembly and wherein the annulus is located downstream of the first fluid mover; flowing the reservoir fluid from the annulus within the charge pump assembly to the fluid inlet of the gas separator assembly; discharging a first portion of the reservoir fluid via the gas phase discharge port to an exterior of the gas separator assembly; discharging a second portion of the reservoir fluid via the liquid phase discharge port to the inlet of the production pump assembly; pumping the second portion of the reservoir fluid by the production pump assembly; and flowing the second portion of the reservoir fluid out of a discharge of the production pump assembly and via a production tubing to a surface location.

A twelfth embodiment, which is the method of the eleventh embodiment further comprising drawing gas from the wellbore into the gas separator by the first fluid mover; flowing the gas downstream by the first fluid mover to the annulus within the charge pump assembly; mixing the gas with reservoir fluid retained by the annulus within the charge pump assembly to form a mix of gas and fluid; and flowing the mix of gas and fluid from the annulus within the charge pump assembly to the inlet of the gas separator assembly.

A thirteenth embodiment, which is the method of the eleventh or the twelfth embodiment, wherein a volume of the annulus is at least 50 cubic inches and less than 1000 cubic inches.

A fourteenth embodiment, which is the method of any of the eleventh through the thirteenth embodiment, further comprising stabilizing the drive shaft by a spider bearing that is concentric with the drive shaft and that is located inside the annulus within the charge pump assembly, wherein the spider bearing provides flow paths for the reservoir fluid between struts of the spider bearing.

A fifteenth embodiment, which is the method of any of the eleventh through the thirteenth embodiment, further comprising stabilizing the drive shaft by a plurality of spider bearings, wherein each spider bearing is concentric with the drive shaft, is located inside the annulus within the charge pump assembly, and provides flow paths for the reservoir fluid between struts of the spider bearing.

A sixteenth embodiment, which is the method of the fifteenth embodiment, wherein each spider bearing is separated from the other spider bearing by at least 4 inches and less than 16 inches.

A seventeenth embodiment, which is the method of assembling an electric submersible pump (ESP) assembly at a wellbore location, comprising coupling a downstream end of an electric motor to an upstream end of a seal unit, including coupling a drive shaft of the electric motor to a drive shaft of the seal unit; lowering the electric motor, and seal unit partially into the wellbore; coupling a downstream end of the seal unit to an upstream end of a fluid intake; coupling a lower end of an inverted shroud to the seal unit or to the electric motor; coupling a downstream end of the fluid intake to an upstream end of a charge pump assembly, including coupling the drive shaft of the seal unit to a drive shaft of the charge pump assembly, wherein the charge pump assembly comprises a first fluid mover mechanically coupled to the drive shaft of the charge pump assembly and having a fluid inlet and a fluid outlet and a fluid reservoir concentrically disposed around the drive shaft of the charge pump assembly and located downstream of the first fluid mover, wherein an inside surface of the fluid reservoir and an outside surface of the drive shaft of the charge pump assembly define a first annulus that is fluidically coupled to the fluid outlet of the first fluid mover; lowering the electric motor, seal unit, fluid intake, and charge pump assembly partially into the wellbore; coupling a gas separator assembly to the ESP assembly so an inlet of the gas separator assembly is in fluid communication with a fluid outlet of the charge pump assembly; coupling an upper end of the inverted shroud to the gas separator assembly or to the charge pump assembly; lowering the electric motor, seal unit, fluid intake, charge pump assembly, and gas separator assembly partially into the wellbore; coupling a downstream end of the gas separator assembly to an upstream end of production pump assembly; and lowering the electric motor, seal unit, fluid intake, charge pump assembly, gas separator assembly, inverted shroud and production pump assembly partially into the wellbore.

An eighteenth embodiment, which is the method of the seventeenth embodiment, wherein the charge pump assembly comprises a plurality of fluid reservoirs.

A nineteenth embodiment, which is the method of either the seventeenth or the eighteenth embodiment, wherein the charge pump assembly further comprises a spider bearing concentric with the drive shaft and located within the first fluid reservoir, wherein the spider bearing comprises struts that provide fluid communication paths between the struts.

A twentieth embodiment, which is the method of any of the seventeenth through the nineteenth embodiment, comprising a second fluid mover mechanically coupled to the drive shaft of the charge pump assembly and having a fluid inlet fluidically coupled to an outlet of the fluid reservoir and a fluid outlet fluidically coupled to the inlet of the gas separator assembly.

A twenty-first embodiment, which is an electric submersible pump (ESP) assembly, comprising an electric motor having a first drive shaft; a seal section coupled at a lower end to an upper end of the electric motor having a second drive shaft coupled to the first drive shaft; a fluid intake coupled at a lower end to an upper end of the seal section, wherein the fluid intake defines at least one intake port; a charge pump assembly coupled at a lower end to an upper end of the fluid intake having an inlet in fluid communication with a fluid outlet of the fluid intake, wherein the charge pump assembly comprises a third drive shaft coupled to the second drive shaft and a fluid mover mechanically coupled to the third drive shaft and having a fluid inlet and a fluid outlet; a gas separator assembly coupled at a downstream end to an upstream end of the charge pump assembly, having a fourth drive shaft coupled to the third drive shaft and having an inlet in fluid communication with an outlet of the charge pump assembly, having a gas flow path and liquid flow path separator having a gas phase discharge port open to an exterior of the gas separator assembly and a liquid phase discharge port; an inverted shroud coupled at an upper end to the gas separator assembly or to the charge pump assembly and coupled at a lower end to the ESP assembly below the fluid intake; and a production pump assembly coupled at a downstream end to an upstream end of the gas separator assembly and having an inlet in fluid communication with the liquid phase discharge port of the gas flow path and liquid flow path separator.

A twenty-second embodiment, which is the ESP assembly of the twenty-first embodiment, wherein the fluid mover of the charge pump assembly comprises at least one centrifugal pump stage, wherein a centrifugal pump stage comprises an impeller coupled to the third drive shaft and a diffuser retained by a housing of the charge pump assembly.

A twenty-third embodiment, which is the ESP assembly of the twenty-first embodiment, wherein the fluid mover of the charge pump assembly comprises a plurality of centrifugal pump stages, wherein each centrifugal pump stage comprises an impeller coupled to the third drive shaft and a diffuser retained by a housing of the charge pump assembly.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of Ike magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru-RI), wherein k is a variable ranging from 1 percent to 100 percent with a 1 percent increment, i.e., k is 1 percent, 2 percent, 3 percent, 4 percent, 5 percent, 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

an electric motor having a first drive shaft;

a seal section coupled at an upstream end to a downstream end of the electric motor having a second drive shaft coupled to the first drive shaft;

a charge pump assembly disposed downstream of the seal section, wherein the charge pump assembly comprises a third drive shaft coupled to the second drive shaft, a first fluid mover mechanically coupled to the third drive shaft and having a fluid inlet and a fluid outlet, a fluid reservoir concentrically disposed around the third drive shaft and located downstream of the first fluid mover, wherein an inside surface of the fluid reservoir and an outside surface of the third drive shaft define a first annulus that is fluidically coupled to the fluid outlet of the first fluid mover, wherein the third drive shaft is not radially supported within the first annulus, wherein when the separator drive shaft is about 0.6875 inches in diameter, the first annulus has a volume of at least 70 cubic inches and less than 100 cubic inches, when the separator drive shaft is about 0.875 inches in diameter, the first annulus has a volume of at least 85 cubic inches and less than 120 cubic inches, when the separator drive shaft is about 1.0 inches in diameter, the first annulus has a volume of at least 180 cubic inches and less than 250 cubic inches, and when the separator drive shaft is about 1.1875 inches in diameter, the first annulus has a volume of at least 220 cubic inches and less than 300 cubic inches, and a second fluid mover mechanically coupled to the third drive shaft and having a fluid inlet and a fluid outlet, wherein the second fluid mover is located downstream of the fluid reservoir, and wherein the fluid inlet of the second fluid mover is fluidically coupled to the first annulus;

a gas separator assembly coupled at an upstream end to a downstream end of the charge pump assembly, having a fourth drive shaft coupled directly or indirectly to the third drive shaft and having an inlet in fluid communication with an outlet of the charge pump assembly, having a gas flow path and liquid flow path separator having a gas phase discharge port open to an exterior of the gas separator assembly and a liquid phase discharge port;

an inverted shroud coupled at an uphole end to the gas separator assembly or to the charge pump assembly and coupled at a downhole end to the ESP assembly downhole of the charge pump assembly; and a production pump assembly coupled at an upstream end to a downstream end of the gas separator assembly and having an inlet in fluid communication with the liquid phase discharge port of the gas flow path and liquid flow path separator.

2. The ESP assembly of claim 1, wherein a distance between a downstream end of the seal section and the gas phase discharge port of the gas flow path and liquid flow path separator is at least 6 feet and less than 500 feet.

3. The ESP assembly of claim 1, wherein the fluid reservoir is at least 6 inches long and less than 17 inches long.

4. The ESP assembly of claim 1, further comprising a spider bearing located within the fluid reservoir that has a central through-hole that surrounds the drive shaft.

5. The ESP assembly of claim 4, wherein the fluid reservoir is at least 17 inches long and less than 34 inches long.

6. The ESP assembly of claim 1, wherein the charge pump assembly further comprises a housing, wherein the inside surface of the fluid reservoir is provided by an inside surface of the housing, wherein the first fluid mover and the second fluid mover are located within the housing.

7. The ESP assembly of claim 6, wherein the first fluid mover comprises at least one centrifugal pump stage, wherein the at least one centrifugal pump stage comprises an impeller mechanically coupled to the third drive shaft and a diffuser retained by the housing.

8. The ESP assembly of claim 1, wherein the first fluid mover is an auger mechanically coupled to the third drive shaft.

9. The ESP assembly of claim 1, further comprising a second fluid reservoir concentrically disposed around the third drive shaft and located downstream of the second fluid mover, wherein an inside surface of the second fluid reservoir and an outside surface of the third drive shaft define a second annulus that is fluidically coupled to the fluid outlet of the second fluid mover.

10. A method of lifting liquid in a wellbore, comprising:

running an electric submersible pump (ESP) assembly into a wellbore, wherein the ESP assembly comprises an electric motor having a first drive shaft, a seal section coupled at an upstream end to a downstream end of the electric motor having a second drive shaft coupled to the first drive shaft, a charge pump assembly disposed downstream of the seal section, wherein the charge pump assembly comprises a third drive shaft coupled to the second drive shaft, a first fluid mover mechanically coupled to the third drive shaft and having a fluid inlet and a fluid outlet, a fluid reservoir concentrically disposed around the third drive shaft and located downstream of the first fluid mover, wherein an inside surface of the fluid reservoir and an outside surface of the third drive shaft define a first annulus that is fluidically coupled to the fluid outlet of the first fluid mover, wherein the third drive shaft is not radially supported within the first annulus, wherein when the separator drive shaft is about 0.6875 inches in diameter, the first annulus has a volume of at least 70 cubic inches and less than 100 cubic inches, when the separator drive shaft is about 0.875 inches in diameter, the first annulus has a volume of at least 85 cubic inches and less than 120 cubic inches, when the separator drive shaft is about 1.0 inches in diameter, the first annulus has a volume of at least 180 cubic inches and less than 250 cubic inches, and when the separator drive shaft is about 1.1875 inches in diameter, the first annulus has a volume of at least 220 cubic inches and less than 300 cubic inches, and a second fluid mover mechanically coupled to the third drive shaft and having a fluid inlet and a fluid outlet, wherein the second fluid mover is located downstream of the fluid reservoir, and wherein the fluid inlet of the second fluid mover is fluidically coupled to the first annulus, a gas separator assembly coupled at an upstream end to a downstream end of the charge pump assembly, having a fourth drive shaft coupled directly or indirectly to the third drive shaft and having an inlet in fluid communication with an outlet of the charge pump assembly, having a gas flow path and liquid flow path separator having a gas phase discharge port open to an exterior of the gas separator assembly and a liquid phase discharge port, an inverted shroud coupled at an uphole end to the gas separator assembly or to the charge pump assembly and coupled at a downhole end to the ESP assembly downhole of the charge pump assembly, and a production pump assembly coupled at an upstream end to a downstream end of the gas separator assembly and having an inlet in fluid communication with the liquid phase discharge port of the gas flow path and liquid flow path separator;

turning the third drive shaft of the charge pump assembly by the electric motor;

drawing reservoir fluid from the wellbore into the charge pump assembly by the first fluid mover;

moving the reservoir fluid downstream by the first fluid mover within the charge pump assembly;

filling the first annulus within the charge pump assembly with the reservoir fluid;

flowing the reservoir fluid from the first annulus to the fluid inlet of the gas separator assembly;

discharging a first portion of the reservoir fluid via the gas phase discharge port to an exterior of the gas separator assembly;

discharging a second portion of the reservoir fluid via the liquid phase discharge port to the inlet of the production pump assembly;

pumping the second portion of the reservoir fluid by the production pump assembly, and flowing the second portion of the reservoir fluid out of a discharge of the production pump assembly and via a production tubing to a surface location.

11. The method of claim 10, further comprising:

drawing gas from the wellbore into the gas separator by the first fluid mover;

flowing the gas downstream by the first fluid mover to the first annulus within the charge pump assembly;

mixing the gas with reservoir fluid retained by the first annulus within the charge pump assembly to form a mix of gas and fluid; and flowing the mix of gas and fluid from the first annulus within the charge pump assembly to the inlet of the gas separator assembly.

12. The method of claim 10, further comprising stabilizing the drive shaft by a spider bearing that is concentric with the drive shaft and that is located between the first annulus and a second annulus defined between the inside surface of the fluid reservoir and the outside surface of the third drive shaft within the charge pump assembly, wherein the spider bearing provides flow paths for the reservoir fluid between struts of the spider bearing.

13. The method of claim 10, further comprising stabilizing the third drive shaft by a plurality of spider bearings, wherein each spider bearing is concentric with the third drive shaft, is located inside the fluid reservoir, and provides flow paths for the reservoir fluid between struts of the spider bearing.

14. The method of claim 13, wherein each spider bearing is separated from the other spider bearing by at least 4 inches and less than 16 inches.

15. A method of assembling an electric submersible pump (ESP) assembly at a wellbore location, comprising:

assembling the ESP assembly that comprises an electric motor having a first drive shaft, a seal section coupled at an upstream end to a downstream end of the electric motor having a second drive shaft coupled to the first drive shaft, a charge pump assembly disposed downstream of the seal section, wherein the charge pump assembly comprises a third drive shaft coupled to the second drive shaft, a first fluid mover mechanically coupled to the third drive shaft and having a fluid inlet and a fluid outlet, a fluid reservoir concentrically disposed around the third drive shaft and located downstream of the first fluid mover, wherein an inside surface of the fluid reservoir and an outside surface of the third drive shaft define a first annulus that is fluidically coupled to the fluid outlet of the first fluid mover, wherein the third drive shaft is not radially supported within the first annulus, wherein when the separator drive shaft is about 0.6875 inches in diameter, the first annulus has a volume of at least 70 cubic inches and less than 100 cubic inches, when the separator drive shaft is about 0.875 inches in diameter, the first annulus has a volume of at least 85 cubic inches and less than 120 cubic inches, when the separator drive shaft is about 1.0 inches in diameter, the first annulus has a volume of at least 180 cubic inches and less than 250 cubic inches, and when separator drive shaft is about 1.1875 inches in diameter, the first annulus has a volume of at least 220 cubic inches and less than 300 cubic inches, and a second fluid mover mechanically coupled to the third drive shaft and having a fluid inlet and a fluid outlet, wherein the second fluid mover is located downstream of the fluid reservoir, and wherein the fluid inlet of the second fluid mover is fluidically coupled to the first annulus, a gas separator assembly coupled at an upstream end to a downstream end of the charge pump assembly, having a fourth drive shaft coupled directly or indirectly to the third drive shaft and having an inlet in fluid communication with an outlet of the charge pump assembly, having a gas flow path and liquid flow path separator having a gas phase discharge port open to an exterior of the gas separator assembly and a liquid phase discharge port, an inverted shroud coupled at an uphole end to the gas separator assembly or to the charge pump assembly and coupled at a downhole end to the ESP assembly downhole of the charge pump assembly, and a production pump assembly coupled at an upstream end to a downstream end of the gas separator assembly and having an inlet in fluid communication with the liquid phase discharge port of the gas flow path and liquid flow path separator by coupling the downstream end of the electric motor to the upstream end of the seal section, including coupling first drive shaft of the electric motor to the second drive shaft of the seal section;

lowering the electric motor, and the seal section partially into the wellbore;

coupling a downhole end of the inverted shroud to the seal section or to the electric motor;

coupling the charge pump assembly to the seal section, including coupling the second drive shaft of the seal section to the third drive shaft of the charge pump assembly;

lowering the electric motor, seal section, fluid intake, and charge pump assembly partially into the wellbore;

coupling the gas separator assembly to the ESP assembly so the inlet of the gas separator assembly is in fluid communication with a fluid outlet of the charge pump assembly;

coupling an uphole end of the inverted shroud to the gas separator assembly or to the charge pump assembly;

lowering the electric motor, seal section, fluid intake, charge pump assembly, and gas separator assembly partially into the wellbore;

coupling the downstream end of the gas separator assembly to the upstream end of production pump assembly; and lowering the electric motor, seal section, fluid intake, charge pump assembly, gas separator assembly, inverted shroud and production pump assembly partially into the wellbore.

16. The method of claim 15, wherein the charge pump assembly comprises a plurality of fluid reservoirs.

17. The method of claim 15, wherein the charge pump assembly further comprises a spider bearing concentric with the third drive shaft and located within the fluid reservoir, wherein the spider bearing comprises struts that provide fluid communication paths between the struts.

18. An electric submersible pump (ESP) assembly, comprising:

an electric motor having a first drive shaft;

a seal section coupled at an upstream end to a downstream end of the electric motor having a second drive shaft coupled to the first drive shaft;

a charge pump assembly disposed downstream of the seal section, wherein the charge pump assembly comprises a third drive shaft coupled to the second drive shaft and a fluid mover mechanically coupled to the third drive shaft and having a fluid inlet and a fluid outlet, wherein the charge pump assembly is configured to flow substantially all of a fluid received by the first fluid mover out an outlet disposed at a downstream end of the charge pump assembly;

a gas separator assembly coupled at an upstream end to a downstream end of the charge pump assembly, having a fourth drive shaft coupled directly or indirectly to the third drive shaft and having an inlet in fluid communication with an outlet of the charge pump assembly, having a gas flow path and liquid flow path separator having a gas phase discharge port open to an exterior of the gas separator assembly and a liquid phase discharge port;

an inverted shroud coupled at an uphole end to the gas separator assembly or to the charge pump assembly and coupled at a downhole end to the ESP assembly downhole of the charge pump assembly; and a production pump assembly coupled at an upstream end to a downstream end of the gas separator assembly and having an inlet in fluid communication with the liquid phase discharge port of the gas flow path and liquid flow path separator.

19. The ESP assembly of claim 18, wherein the fluid mover of the charge pump assembly comprises at least one centrifugal pump stage, wherein a centrifugal pump stage comprises an impeller coupled to the third drive shaft and a diffuser retained by a housing of the charge pump assembly.

20. The ESP assembly of claim 18, wherein the fluid mover of the charge pump assembly comprises a plurality of centrifugal pump stages, wherein each centrifugal pump stage comprises an impeller coupled to the third drive shaft and a diffuser retained by a housing of the charge pump assembly.

21. The ESP assembly of claim 1, wherein the inverted shroud comprises a shroud inlet that defines shroud inlet ports, wherein the shroud inlet couples the uphole end of the inverted shroud assembly to the gas separator assembly or to the charge pump assembly.

22. The method of claim 13, wherein the plurality of spider bearings separate the first annulus from one or more additional annuluses defined between the inside surface of the fluid reservoir and the outside surface of the third drive shaft downstream of the first annulus.

23. The method of claim 17, wherein the spider bearing separates the first annulus from a second annulus defined between the inside surface of the fluid reservoir and the outside surface of the third drive shaft downstream of the first annulus.

* * * * *